United States Patent [19]

Horinouchi

[11] 4,356,370

[45] Oct. 26, 1982

[54] APPARATUS FOR CONTROLLING ELECTRONIC CONTROLLED COOKING APPARATUS

[75] Inventor: Atsushi Horinouchi, Otsu, Japan

[73] Assignee: Sanyo Electric Co., Ltd., Moriguchi, Japan

[21] Appl. No.: 130,152

[22] Filed: Mar. 13, 1980

[30] Foreign Application Priority Data

Mar. 19, 1979 [JP] Japan ..... 54-33094

[51] Int. Cl.[3] ..... H05B 6/68

[52] U.S. Cl. ..... 219/10.55 B; 219/492; 219/506; 99/325; 364/900

[58] Field of Search ..... 219/10.55 B, 10.77, 219/489, 490, 492, 501, 506; 364/900 MS File, 200 MS File; 99/325, 331, 332, 333

[56] References Cited

U.S. PATENT DOCUMENTS

| | | | |
|---|---|---|---|
| 3,462,741 | 8/1969 | Bush et al. | 364/200 |
| 3,932,843 | 1/1976 | Trelut et al. | 364/200 |
| 4,220,840 | 9/1980 | Barker | 219/10.55 B |

FOREIGN PATENT DOCUMENTS

| | | | |
|---|---|---|---|
| 55-8580 | 1/1980 | Japan | 219/10.55 B |

OTHER PUBLICATIONS

Electronic Design 22, "Microprocessors Simplify Industrial Control Systems", Weissberger, pp. 96–99, 10/75.

*Primary Examiner*—Reynolds B. A.
*Assistant Examiner*—Philip H. Leung
*Attorney, Agent, or Firm*—Darby & Darby

[57] ABSTRACT

A microwave oven comprises two microprocessors. One microprocessor is responsive to entry of the data from a keyboard to control an external storage and to provide the data concerning a cooking condition to the other microprocessor. The other microprocessor is responsive to the data obtained from one microprocessor to make a display thereof and to control generation of the high frequency energy based on the data concerning a cooking condition included in the above described data. Transfer of the data from one microprocessor to the other microprocessor is made responsive to coincidence of individual synchronizing signals of the respective microprocessors or is made responsive to interruption to one microprocessor from the other microprocessor.

18 Claims, 21 Drawing Figures

Vc
GND
INT
OB
MICRO-PROCESSOR
FROM 219
TO 205
DS1-DS9
IC1
IC2
RESET
FROM 209
FROM 211
FROM 213
DG1
DG2
DG3
DG4
DG5
OT1~4
OP
OM
UD'
TO 215
TO 331
TO 329
201
401
CLOCK CIRCUIT
15
DISPLAY
403
101
GND
UA
R/W
UD2
MICRO-PROCESSOR
B1
B2
INT
U1
U2
U3
UD1
109
RAM
ENCODER
113
KEY MATRIX
111

APPARATUS FOR CONTROLLING ELECTRONIC CONTROLLED COOKING APPARATUS

BACKGROUND OF THE INVENTION

1. Field of the Invention

The present invention relates to an apparatus for controlling an electronic controlled cooking apparatus. More specifically, the present invention relates to an apparatus for controlling a cooking apparatus such as a microwave oven for controlling a cooking condition and the like using a microprocessor.

2. Description of the Prior Art

As an example of a heat cooking apparatus, microwave ovens are well-known. Of late, a microprocessor implemented as a large scale integration has been employed in such a microwave oven for the purpose of performing various cooking functions. A microwave oven employing a microprocessor can perform various complicated cooking modes with a simple structure and through a simple manual operation.

A conventional cooking apparatus of this type has employed a single microprocessor for performing any types of controls in the apparatus. More specifically, one microprocessor has been employed for controlling entry of the data through a key board and for controlling a high frequency energy source, a display, a storage and the like serving as a load of the processor. On the other hand, it is more preferred and has been desired that as many cooking conditions or cooking programs as possible can be set in such cooking apparatus. However, such a conventional apparatus adapted for performing all the processing or control by the use of only one microprocessor was liable to be short of a capacity or capability and was not able to sufficiently satisfy the above described requirements and hence resulted in the disadvantage that a cooking operation cannot be achieved in a variety of operation manners.

SUMMARY OF THE INVENTION

The present invention is characterized by employment of at least two microprocessors in controlling an electronic controlled cooking apparatus. One microprocessor is adapted to perform a control necessary for commanding a cooking condition, while the other microprocessor is adapted to control a data display and to control a supply of energy for cooking based on various types of control parameters and the commanded cooking condition.

According to the present invention, since a different processing or control can be performed depending on the performance of a separate microprocessor, as necessary, versatility of controls of cooking conditions is drastically increased as compared with a conventional cooking apparatus employing only one microprocessor. In addition, since the number of microprocessors can be increased to the optimum as the load of controls and the like increase, such versatility is further enhanced by employment of an optimum number of microprocessors.

In a preferred embodiment of the present invention, transfer of the data entered from entry means to one microprocessor and transfer of the data from one microprocessor to the other microprocessor are controlled by a combination of gate means and multiplexer means. According to the embodiment in discussion, an apparatus bringing about the above described advantages can be implemented with a relatively simple structure.

In another preferred embodiment of the present invention, for the purpose of further simplifying a structure, transfer of the data from one microprocessor to the other microprocessor is made only when a demand signal or an interrupt signal from the other microprocessor is obtained and as a result the above described gate means and multiplexer means are dispensed with.

Accordingly, a principal object of the present invention is to provide an improved apparatus for controlling an electronic controlled cooking apparatus.

Another object of the present invention is to provide an improved electronic controlled cooking apparatus employing a plurality of microprocessors.

A further object of the present invention is to provide an improved electronic controlled cooking apparatus, wherein processing or control is borne in an optimized manner by a plurality of microprocessors.

Still a further object of the present invention is to provide an improved apparatus for controlling an electronic controlled cooking apparatus, utilizing a plurality of microprocessors with a relatively simple structure.

Still another object of the present invention is to provide an improved apparatus for controlling an electronic controlled cooking apparatus, which controls a variety of cooking conditions with a relatively simple structure.

These objects and other objects, features, aspects and advantages of the present invention will become more apparent from the following detailed description of the present invention when taken in conjunction with the accompanying drawings.

DESCRIPTION OF THE PREFERRED EMBODIMENTS

In the following detailed description of the preferred embodiments of the present invention, the present invention will be described as advantageously employed in a microwave oven. However, it should be pointed out that the present invention is not limited to such embodiments but the present invention can be employed in any other types of heat cooking apparatuses for cooking a material being cooked by application of heat thereto, such as a gas oven, an electric oven, an electric grill, an electric roaster an the like.

Figure 1A:
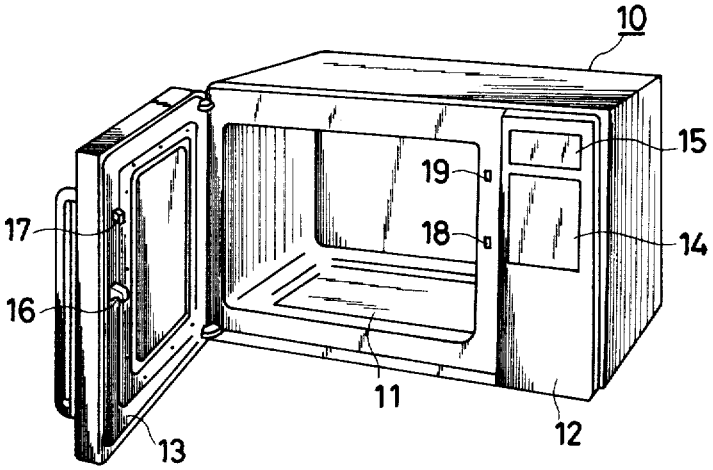
FIG. 1A is a perspective view showing a microwave oven as an example of an electronic controlled cooking apparatus in which the present invention can be advantageously employed.
Figure 1B:
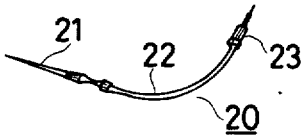
FIG. 1B is a perspective view of a temperature measuring probe which may be used with the oven of FIG. 1A.

FIG. 1A is a perspective view of a microwave oven embodying the present invention. FIG. 1B is a view showing a temperature measuring probe as one example of a temperature detecting means. A microwave oven 10 has a main body comprising a cooking chamber 11 and a control panel 12. The main body of the microwave oven has a door 13 openably/closably provided to enclose an opening of the cooking chamber 11. The control panel 12 comprises an operation portion 14 for setting various cooking modes and for entering necessary data, and a display 15 for displaying in a digital manner the entered data, a measured temperature, a time period left in a timer, and the like. The operation portion 14 and the display portion 15 will be described in more detail subsequently. The door 13 is provided with a door latch 16 and a door switch knob 17 on the inner surface thereof. The door latch 16 and the door switch knob 17 are adapted to enter into apertures 18 and 19, respectively, formed on the main body, when the door 13 is closed, so that an interlock switch and a door switch, respectively, shown in FIG. 2, may be turned on.

A probe 20 comprises a needle-like inserting portion 21 and a plug 23. In using the probe 20, the inserting portion 21 is inserted into a material being cooked, while the plug 23 is coupled to a connecting portion or a receptacle, not shown, provided on the inner wall of the cooking chamber 11. The inserting portion 21 of the probe 21 comprises a thermistor, not shown, housed therein exhibiting a resistance characteristic changeable as a function of a temperature of a material being cooked. The thermistor and the plug 23 are coupled by a shielded wire 22, for example, so that the probe 20 is coupled to the circuit shown in FIG. 2 when the probe 20 is utilized.

Figure 2:
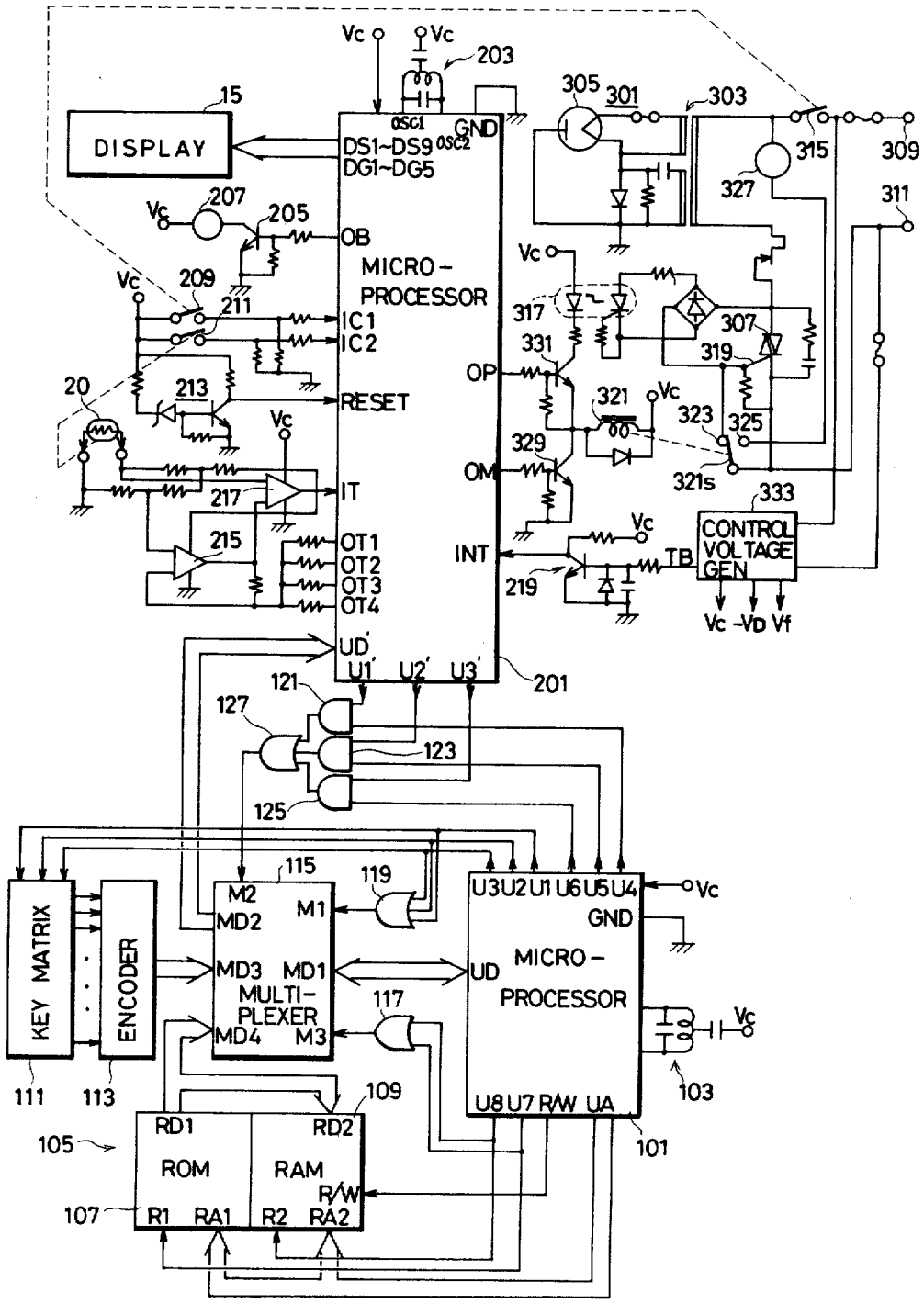
FIG. 2 is a block diagram showing a preferred embodiment of the present invention.

FIG. 2 is a schematic diagram of a preferred embodiment of the present invention. The embodiment shown comprises two microprocessors 101 and 201. One microprocessor 101 is connected to receive the data entered through the operation portion 14 and thus obtained from the key matrix 111. The microprocessor 101 is responsive to the data as entered to control the reading from and the writing into an external storage 105 and to provide the data concerning a commanded cooking condition to the other microprocessor 201. Now a circuit structure being controlled by the microprocessor 201 will be first described and then an association thereof with one microprocessor 101 will be described.

A microwave generating portion 301 is coupled to terminals 309 and 311 of a commercial power supply through a door switch 315 and a bidirectional thyristor 307. The microwave generating portion 301 is structured in a well known manner and may comprise a high voltage transformer 303 for transforming a source voltage obtained from the terminals 309 and 311, a magnetron 305 coupled to the output winding of the high voltage transformer 303, and the like. The door switch 315 is adapted to be turned on by means of the door latches 16 and 18 and the door switch knobs 17 and 19, shown in FIG. 1A. The bidirectional thyristor 307 is rendered conductive if and when the output voltage of a photocoupler 317 is applied to the gate electrode 319 thereof. Accordingly, if and when the door 13 shown in FIG. 1A is closed and the output voltage is obtained from the photocoupler 317, an alternating current source voltage obtained from the terminals 309 and 311 is applied to the microwave generating portion 301 and accordingly a microwave is generated from the microwave generating portion 301, which microwave energy is supplied to the cooking chamber 11 shown in FIG. 1A. The photocoupler 317 becomes operative if and when a first and second transistors 329 and 331 are both rendered conductive, whereby an output voltage is withdrawn.

The gate electrode 319 of the bidirectional thyristor 307 is coupled to the voltage source terminal 311 through a normally closed contact 323 of a relay 321. Accordingly, the gate 319 is normally short-circuited and therefore the gate electrode 319 is prevented from being undesirably supplied with a voltage due to an external noise and the like and hence the bidirectional thyristor 307 is prevented from being undesirably rendered conductive. The relay 321 is energized when the first transistor 329 is rendered conductive, a normally opened contact 325 of the relay 321 being connected to a blower motor 327. The blower motor 327 is adapted for driving a fan, not shown, for cooling the magnetron 305 and the like. The voltage source terminals 309 and 311 are further connected to a control voltage source 333. The control voltage source 333 comprises a transformer, not shown, for transforming the voltage supplied from the terminals 309 and 311 to a lower voltage for supplying direct current source voltages $V_C$ and $-VD$ fed to various portions of the circuit, a voltage Vf fed to a display 15 and a time base signal TB.

The embodiment shown employs, as the microprocessor 201, a one chip microprocessor implemented as a large scale integration for controlling the above described microwave generating portion 301 and the like. The microprocessor 201 may be model "μPD553" manufactured by Nippon Electric Company Limited, Japan, for example. The microprocessor 201 has a multiplicity of input and output terminals. Connection terminals OSC1 and OSC2 are used for connecting an external component 203 constituting a portion of a clock source. The external component 203 is cooperative with the microprocessor 201 to generate a synchronizing clock, so that the microprocessor 201 may execute the program steps in synchronism with the clock. Although not shown in the figure, the microprocessor 201 comprises a read only memory having system programs for controling the magnetron 305 based on various control parameters and cooking condition data and the like, a random-access memory for storing data, an arithmetic logic unit and the like, as well known to those skilled in the art.

The microprocessor 201 is coupled to the display 15 through data output terminals DS1 to DS9. The display 15 is further supplied with a display control signal through control signal output terminals DG1 to DG5. The display control signal functions as a digit selecting signal for driving in a time sharing basis each of display digits to be described subsequently of the display 15.

Figure 4:
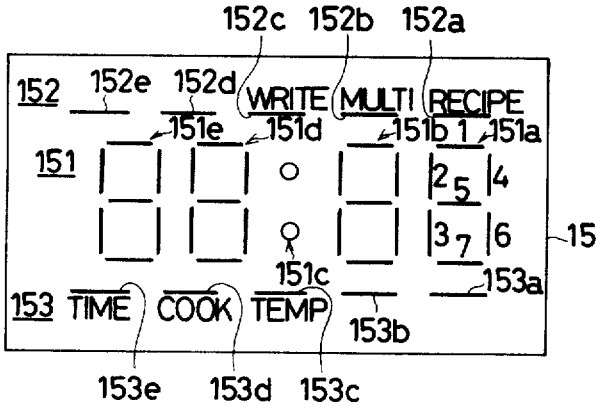
FIG. 4 is a view showing one example of a display.

The display 15 is structured as shown in FIG. 4, for example, by means of a fluorescent type display tube. More specifically, the display 15 comprises a numerical value display portion 151 and bar display portions 152 and 153. The numerical value display portion 151 comprises four numeral display portions **151*a*, 151*b*, 151*d* and 151*e*, each including an "8" shaped segment arrangement, and a colon display portion 151*c* formed between the numeral display portions 151***b* and 151*d*. The bar display portions 152 and 153 each have bar segments 152*a* to 152*c* and 153*a* to 153*e* corresponding to each of the digits of the numerical value display portion 151. Above the bar segments 152*a*, 152*b*, and 152*c*, indications "RECIPE", "MULTI", and "WRITE" are formed, respectively, and below the bar segments 153*c*, 153*d*, and 153*e*, indications "TEMP", "COOK", and "TIME" are formed, respectively. These indications "RECIPE", "MULTI", "WRITE", "TEMP", "COOK", and "TIME" are aimed to display the contents or kinds of the data being displayed by the display 15. The output signal obtained from the output terminals DG1 to DG5 of the microprocessor 201 functions as a digit selecting signal of the respective display digits a to e. On the other hand, the output signal obtained from the output terminals DS1 to DS7 functions as a segment selecting signal corresponding to the respective segments in each of the numeral display portions. The output signal obtained from the output terminals DS8 and DS9 functions as a selection signal of the bar display portions 152 and 153. Accordingly, if and when a signal is obtained from the output terminal DG2, for example, and the output signal is obtained at the terminals DS1, DS3, DS4, DS5 and DS7, a numeral "2" is displayed at the numeral display portion 151*b*. The output signal obtained from the output terminal DS1 functions as a selection signal of the colon display 151*c*. Accordingly, if and when the output signal is obtained from the output terminal DG3 and the output signal is obtained from the terminals DS1 and DS8, the colon display 151*c* is enabled to emit light and the bar segment 152*c* is also enabled to emit light.

Returning to FIG. 2, the output terminal OB of the microprocessor 201 is a buzzer terminal. If and when an output signal is obtained at the terminal OB, the transistor 205 coupled thereto is rendered conductive, whereby the buzzer 207 is driven to raise an alarm. The buzzer 207 is used to generate a confirmation alarm or an alarming or notifying sound responsive to a key operation of the above described operation portion 14, completion of cooking, and the like.

The input terminal IC1 of the microprocessor 201 is an input terminal for detecting an opened/closed state of the door 13 shown in FIG. 1. More specifically, the second door switch 209 adapted to be turned on responsive to the door switch knob 17 (FIG. 1) is connected to the input terminal IC1. Accordingly, in the absence of the input signal at the terminal IC1, i.e. if and when the second door switch 209 is turned off, the microprocessor 201 determines that the door 13 has been opened. In such a situation, the microprocessor 201 performs necessary operations such as interruption of its own operation, and the like.

The input terminal IC2 is an input terminal for detecting a connected/disconnected state of the probe 20. More specifically, a probe switch 211 for detecting the probe 20 is connected to the input terminal IC2. The probe switch 211 is operable in a ganged fashion with a receptacle, not shown, provided on the inner wall of the cooking chamber 11 (FIG. 1), such that the probe switch 211 is turned on when the probe 20 is connected to the receptacle. Accordingly, the microprocessor 201 determines a connected/disconnected state of the probe 20 based on presence or absence of an input signal to the input terminal IC2.

The input terminal RESET is a terminal for initially resetting the microprocessor 201 upon turning on of a power supply to the microwave oven. More specifically, if and when the power supply is turned on, the rise of the source voltage $V_C$ obtained from the control voltage source 333 is detected by means of a detecting circuit 213 implemented by a transistor and a Zener diode. The output from the detecting circuit 213 is applied to the terminal RESET. Then the microprocessor 201 resets the respective portions to an initial condition.

The input terminal IT and the output terminals OT1 to OT4 are terminals for temperature measurement by the probe 20. The microprocessor 201 provides a binary signal of four bits at the output terminals OT1 to OT4, so that the bit pattern of the binary signal is changed in a cyclic manner at a high speed to sixteen states of "0000", "0001", . . . "0100", . . . "1100", . . . "1111". The above described sixteen states of the binary signal each have been defined to represent a particular temperature. For example, the bit pattern "0000" is allotted to 185° F., for example, and the bit pattern "1111" is allotted to 110° F., for example, while one change of the bit pattern is allotted to a change of 5° F. The binary signal output of four bits at the output terminals OT1 to OT4 are converted to a stepwise analog voltage by means of an amplifier 215 commonly coupled to resistors coupled to the output terminals OT1 to OT4, respectively. The analog voltage obtained from the amplifier 215 contains information concerning the binary signal, i.e. the temperature and is applied to one input of a comparator 217. The other input of the comparator 217 is connected to receive a voltage associated with the temperature of a material being cooked, not shown, obtained from the probe 20 connected to the receptacle, not shown. The comparator 217 provides a coincidence signal if and when these two input voltages coincide with each other, which coincidence signal is applied to the input terminal IT of the microprocessor 201. If and when the signal is received at the terminal IT, the microprocessor 201 immediately stops a change of the above described four-bit pattern of the binary signal. More specifically, a bit pattern of the four-bit binary signal obtainable when the above described coincidence signal is inputted substantially corresponds to a temperature of the material being cooked as detected by the probe 20 and the microprocessor 201 processes the above described bit pattern of the binary signal as a temperature of the material being cooked.

An interrupt signal is applied to the input terminal INT of the microprocessor 201. More specificaly, the time base signal obtained from the above described control voltage source 333 is an alternating current signal of say 60 Hz and is shaped into a pulse signal of say 60 Hz by means of a wave shaping circuit 219 comprising a transistor, a diode and a capacitor, whereupon the pulse signal is applied to the input terminal INT. Each time the pulse signal obtained from the wave shaping circuit 219 is applied to the input terminal INT, the microprocessor 201 interrupts any other processing, whereupon timing processing is performed. More specifically, the microprocessor 201 functions to generate a signal representing "second", a signal representing "minute", and a signal representing "hour" in synchronism with the above described pulse signal of 60 Hz.

The output terminals OM and OP are a heat command terminal and an output level command terminal, respectively. In performing a heat processing operation, the microprocessor 201 just provides an output signal at the output terminal OM and then provides an output signal at the output terminal OP with a slight delay. Upon completion of execution of the heating operation, the output signals at the two terminals OM and OP are caused to disappear. If and when the output signal is obtained at the output terminal OM, the first transistor 329 is rendered conductive and accordingly the relay 321 is energized. Accordingly, the normally closed contact 323 is turned off and the normally opened contact 325 is turned on. Accordingly, a short circuit state of the gate electrode 319 of the bidirectional thyristor 307 is released and the blower motor 321 is energized. When the output is obtained from the output terminal OP thereafter, the second transistor 331 is rendered conductive and the photocoupler 317 becomes operative. Then the output signal at the output terminal OP is obtained for a time period associated with an output level being set within each cycle which is determined as 10 seconds, for example. Assuming that a microwave output generated by the magnetron 305 is selected to be the maximum level, for example, the output signal is obtaIned for a full period of time in each cycle, and assuming that the microwave output is selected to be a 50% level, the output signal is obtained for five seconds, for example, within each cycle.

Thus, the microprocessor 201 mainly controls the microwave generating portion 301 based on various types of parameters such as control data, temperature data and the like obtained from the microprocessor 101 to be described subsequently and also controls the display 15. Since a specific control manner of such microprocessor 201 is well known to those skilled in the art, a detailed description thereof will be omitted. Only for reference, one example of such control is disclosed in detail in several copending patent applications assigned to the same assignee, one of which is U.S. patent application Ser. No. 076,754, filed Sept. 19, 1979 now abandoned.

Figure 3:
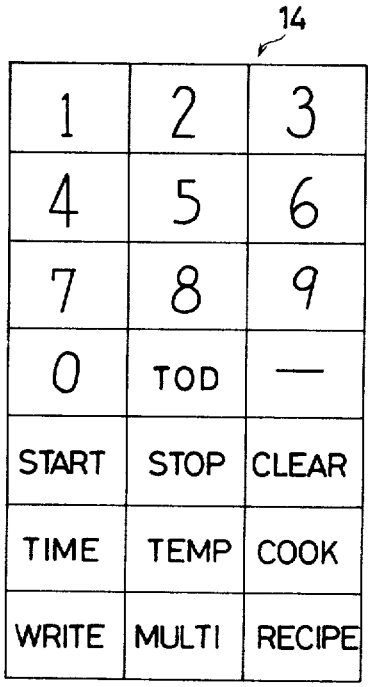
FIG. 3 is a view showing one example of a key board being used as an entry means or an operation means of information being commanded.
Figure 5:
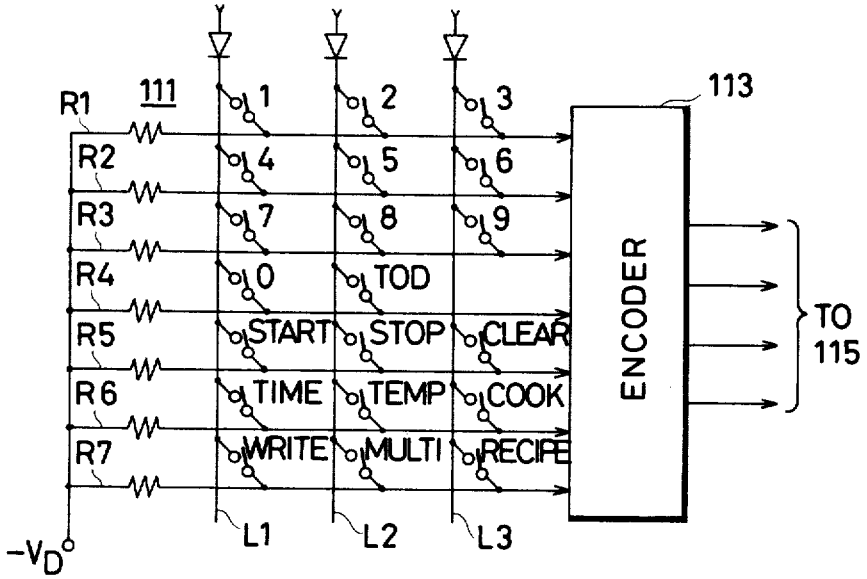
FIG. 5 is a schematic diagram of one example of a key matrix.

The microprocessor 101 may be the same type as the previously described microprocessor 201 and takes its share of the operation of the operation portion or the keyboard 14 and thus the key matrix 111 and the external storage 105. The key matrix 111 comprises three column lines L1 to L3 and seven row lines R1 to R7, as shown in FIG. 5. The three column lines L1, L2 and L3 are connected to receive synchronizing signals U1, U2 and U3 from the microprocessor 101. The row lines R1 to R7 are commonly connected at one end to the negative voltage source $-V_D$ and at the other end connected to the input of an encoder 113. At the respective intersections between these column lines L1 to L3 and the row lines R1 to R7 key switches are connected in accordance with a key arrangement as shown in FIG. 3. If and when the control signals or the synchronizing signals U1, U2 and U3 are received from the microprocessor 101, the corresponding signal potential is supplied to the respective column lines L1, L2 and L3 of the matrix 111. On the other hand, the encoder 113 connected to the row lines R1 to R7 of the matrix 111 serves to convert the input obtained from the respective row lines R1 to R7 to a four-bit code. Accordingly, the state of depression or operation of a given key in the key board 14 is detected when any one of the synchronizing signals U1, U2 and U3 is obtained and a coded signal corresponding to the key is obtained from the encoder 113. Meanwhile, although three keys correspond to one four-bit code thus obtained from the encoder 113, the microprocessor 101 takes the advantage of a synchronizing relation with the synchronizing signals U1, U2 and U3 to discriminate or identify each of these keys. These keys may be of a so-called touch switch type of a static capacitance or an ordinary contact type push button switch. The respective switches of the key matrix 111, i.e. the respective switches of the operation portion or the keyboard 14 shown in FIG. 3 comprise ten numeral keys for the numerals "0" to "9" and ten functional keys. The function keys comprise those keys denoted as TOD, TIME, TEMP, COOK, CLEAR, START, STOP, WRITE, MULTI and RECIPE. The TOD key is used for time setting. The TIME key is used for setting a timer operation mode. The TEMP key is used for setting a temperature operation mode. The COOK key is used for setting a heat cooking mode. The START key is used for commanding initiation of microwave generation by the magnetron 305. The STOP key is used to stop or discontinue the operation. The CLEAR key is used for clearing the programs and the like in the random-access memory 109. The WRITE key is used to write a cooking program into the random-access memory 109 of the external storage 105. The MULTI key is used to enter a multiple associated with the weight of a material being cooked, not shown. More specifically, a fixed cooking program stored in the read only memory 107 and the random-access memory 109 of the external storage 105 has been set with respect to a unit weight say 100 g. Therefore, in order to achieve a heat cooking operation of a material being cooked of the weight larger than the unit weight, it is necessary to modify the above described fixed cooking program in accordance with the weight of the material being cooked and the MULTI key is used to enter the data concerning the weight of the material being cooked in the form of a multiple of the unit weight of 100 g. The RECIPE key is used in commanding or setting a fixed cooking program as described above. The WRITE key, the MULTi key and the RECIPE key will be described in more detail subsequently.

A four-bit binary code obtained from the encoder 113 (in the embodiment shown, a binary code of seven kinds, i.e. "0001"to "0111") is applied to the data terminal MD3 of the multiplexer 115. The multiplexer 115 comprises data terminals MD1, MD2 and MD4, apart from the data terminal MD3. The multiplexer 115 further comprises control terminals, M1, M2 and M3. A one-bit logical signal, i.e. the logic one or zero, is applied to these control terminals M1, M2 and M3, so that the multiplexer 115 makes connection between specified two ones among the data terminals MD1 to MD4 for transmission of the data therebetween based on the control signal being applied thereto.

The data obtained from the external storage 105 is applied to the data terminal MD4 of the multiplexer 115. The external storage 105 comprises the read only memory 107 and the random-access memory 109. The read only memory 107 is used to store a fixed cooking program as in advance written and the random-access memory 109 is used to store a cooking program being written by an operator. For example, the read only memory 107 comprises memory sections allotted for the cooking numbers #1 to #20 and the random-access memory 109 comprises memory sections allotted to the cooking numbers #21 to #40. The external storage 105 is controlled responsive to the synchronizing signals U7 and U8 and the address signal UA obtained from the microprocessor 101. A reading and writing operation of the random-access memory 109 is controlled responsive to the signal R/W obtained from the microprocessor 101. More specifically, if and when the synchronizing signal U7 is obtained from the microprocessor 101, the read only memory 107 is designated, while if and when the synchronizing signal U8 is obtained, the random-access memory 109 is designated. If and when the signal from the terminal R/W of the microprocessor 101 is the high level, the data is written in the random-access memory 109 and if and when the signal is the low level, the data is read from the random-access memory 101. The signal obtained from the address terminal UA serves to specify the memory sections or the addresses of the read only memory 107 and the random-access memory 109. The read only memory 107 comprises a data terminal RD1 and the random-access memory 109 comprises a data terminal RD2. The data terminal RD1 of the read only memory 107 and the data terminal RD2 of the random-access memory 109 are commonly connected to the data terminal MD4 of the multiplexer 115. More specifically, the read only memory 117 provides the data to the multiplexer 115 and the random-access memory 109 performs transmission and reception of the data to and from the multiplexer 115.

The data terminal MD1 of the multiplexer 115 is connected to the data terminal UD of the microprocessor 101. Both of the synchronizing signals U7 and U8 obtained from the microprocessor 101 are applied through an OR gate 117 to the control terminal M3 of the multiplexer 115. The synchronizing signals U1 and U2 and U3 are applied through an OR gate 119 to the control terminal M1 of the multiplexer 115. The control terminal M2 of the multiplexer 115 is supplied with the output from an OR gate 127 to be described subsequently. The data terminal MD2 of the multiplexer 115 is connected to the data terminal UD' of the other microprocessor 201.

The microprocessor 101 further comprises control terminals U4, U5 and U6 in addition to the previously described control terminals U1, U2, U3, U7, U8 and R/W. The synchronizing signals or the scanning signals obtained from the control terminals of the microprocessor 101 are applied to corresponding AND gates 121, 123 and 125, respectively, at one input thereof. The control terminals U1', U2' and U3' of the microprocessor 201 are connected to these AND gates 121, 123 and 125, respectively, at the other input thereof. Accordingly, each of these AND gates 121, 123 and 125 provides the output, if and when the corresponding two inputs of each gate become the high level or the logic one simultaneously. The outputs of these AND gates 121, 123 and 125 are applied through an OR gate 127 to the control terminal M2 of the multiplexer 115.

An external component 103 constituting a clock source is coupled to the microprocessor 101. The microprocessor 101 is responsive to the clock obtained from the clock source to provide the synchronizing signals or the scanning signals at the above described respective control terminals U1 to U8. Likewise, the microprocessor 201 is responsive to the clock obtained from a clock source included in an external component 203 to provide the synchronizing signals or the scanning signals at the above described respective control terminals U1' to U3'.

Figure 7:
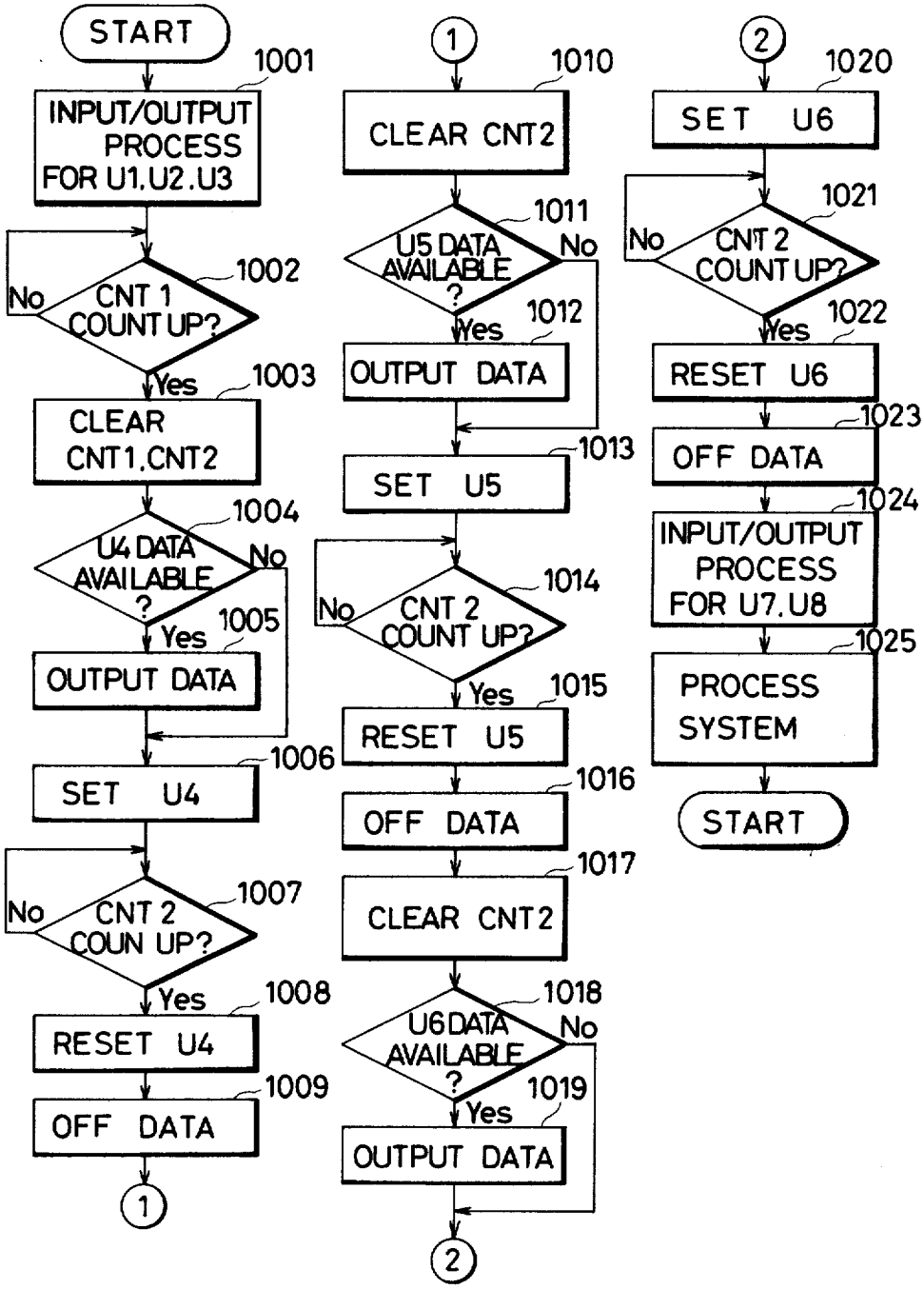
FIGS. 7 and 8 are flow diagrams for depicting an operation in accordance with the FIG. 6 timing chart.
Figure 8:
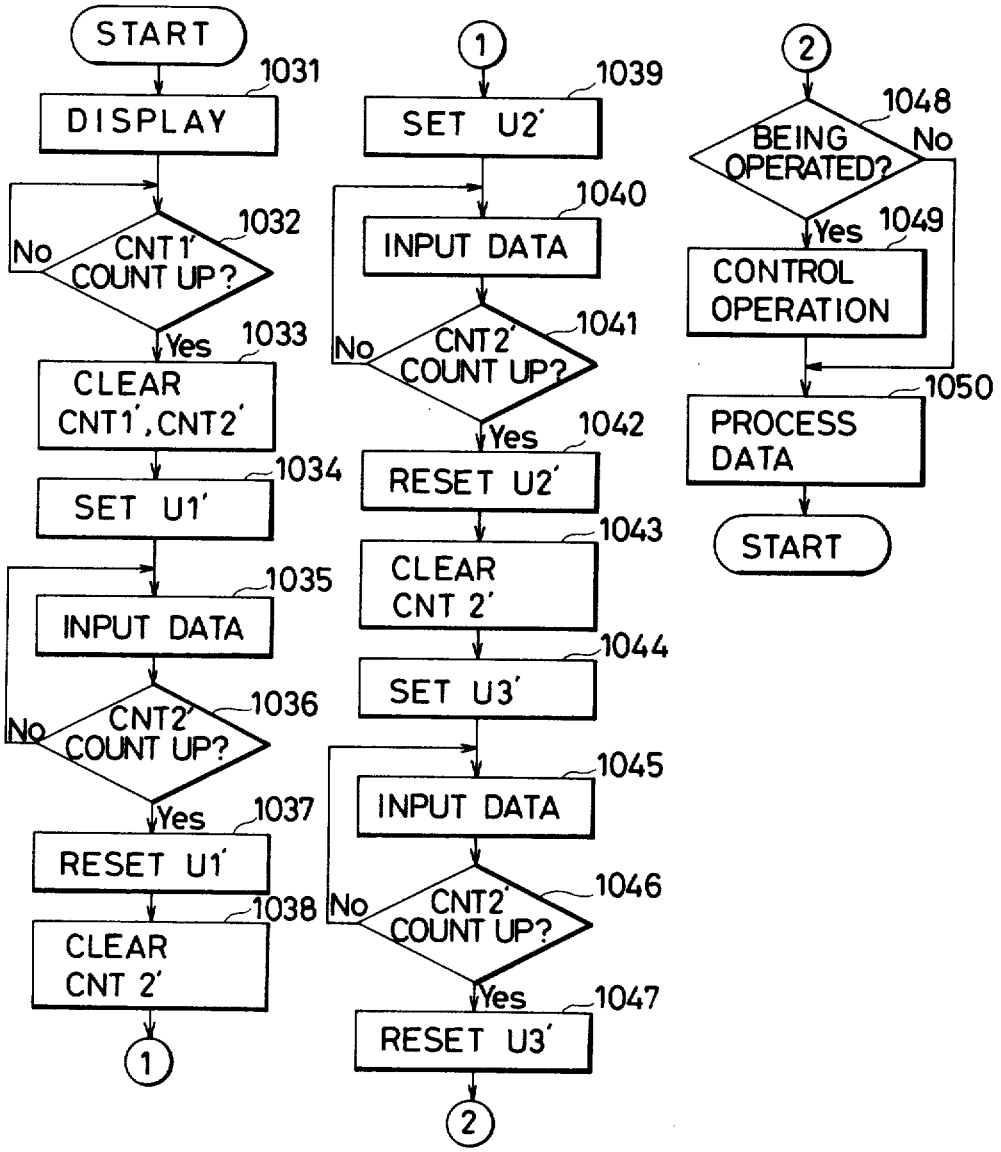

Now that the structural features of the embodiment were described in the foregoing, an operation of the FIG. 2 embodiment will be described with simultaneous reference to a time chart shown in FIG. 6 and flow diagrams shown in FIGS. 7 and 8. FIG. 7 is a flow diagram for depicting an operation of the microprocessor 101 and FIG. 8 is a flow diagram for depicting an operation of the microprocessor 201.

Before entering into a detailed description, keying input detection by means of the microprocessor 101 will be described. The microprocessor 101 successively and periodically provides first synchronizing signals or scanning signals as shown as (A), (B) and (C) in FIG. 6 at the control terminals U1, U2 and U3, respectively. If and when a synchronizing signals or a scanning signal is obtained from any one of these control terminals U1 to U3, the same is applied to the corresponding one of the column lines L1 to L3 of the key matrix 111 shown in FIG. 5, as described previously. At that time, an output is obtained from the OR gate 119 and the signal of the high level or the logic one is applied to the control terminal M2 of the multiplexer 115. Accordingly, the multiplexer 115 is responsive to the signal applied to the control terminal M2 to make connection between the data terminals MD1 and MD3 to enable data transmission therebetween. If and when any one of the keys shown in FIG. 3 or FIG. 5 is manually operated, a four-bit binary code signal associated with the operated key is supplied from the encoder 113 through the data terminals MD3 and MD1 of the multiplexer 115 connected to each other to the data terminal UD of the microprocessor 101. Thus the microprocessor 101 reads the code corresponding to the key operated in the operation portion or the keyboard 14 and thus in the key matrix 111.

Figure 6:
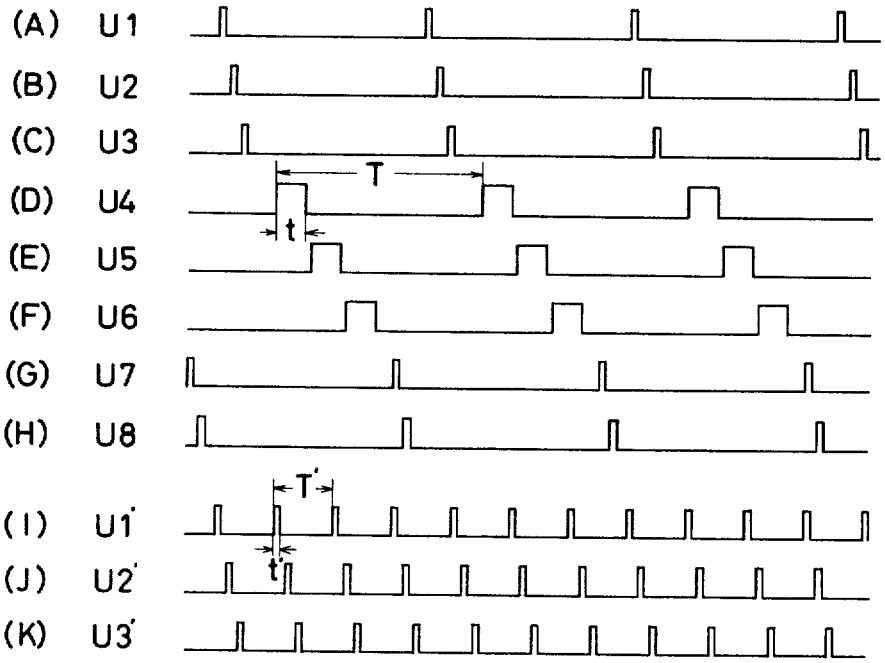
FIG. 6 is a timing chart for depicting an operation of the FIG. 2 embodiment.

Furthermore, the microprocessor 101 normally provides in a cyclic manner the second scanning signals as shown as (D), (E) and (F) in FIG. 6 at the control terminals U4, U5 and U6 thereof, respectively. On the other hand, the microprocessor 201 provides the synchronizing signals or the scanning signals of the high level or the logic one as shown as (I), (J) and (K) in FIG. 6 at the control terminals U1', U2' and U3' thereof, respectively. The AND gate 121 provides an output of the high level or the logic one, if and when the control terminal of the microprocessor 101 and the control terminal U1' of the microprocessor 201 both have been set. Likewise, the AND gate 123 provides the output if and when both the control terminals U5 and U2' become the high level or the logic one, and the AND gate 125 provides the output if and when both the signals at the control terminals U6 and U3' become the high level or the logic one. If and when an output is obtained from any one of these AND gates 121, 123, and 125, the same is applied through the OR gate 127 to the control terminal M2 of the multiplexer 115. The multiplexer 115 is responsive to the signal of the high level or the logic one applied to the control terminal M2 to make connection between the data terminals MD2 and MD1 for data transmission therebetween.

The microprocessor 101 further normally provides in a cyclic manner the third scanning signals as shown as (G) and (H) in FIG. 6 from any one of the control terminals U7 and U8. The signal obtained at the control terminal U7 is applied to the read only memory 107 and the signal obtained at the control terminal U8 is applied to the random-access memory 109. At the same time, the signals obtained at these control terminals U7 and U8 are applied to an OR gate 117. Accordingly, if and when the signal of the high level or the logic one is obtained from any one of the control terminals U7 and U8, the same is applied through the OR gate 117 to the control terminal M3 of the multiplexer 115. The multiplexer 115 is responsive to the signal applied to the control terminal M3 to make connection between the data terminals MD1 and MD4 for data transmission therebetween. The operation of the embodiment will be described in more detail in the following with reference to the flow diagrams shown in FIGS. 7 and 8.

At the step 1001 the microprocessor 101 performs a processing operation of the input and output associated with the previously described control terminals U1, U2 and U3. More specifically, at the step 1001 the data is read from the operation portion 14, i.e. the key matrix 111 or the encoder 113. On the other hand, although not shown, the microprocessor 101 comprises a random-access memory, wherein counter regions CNT1 and CNT2 are formed. The counter regions CNT1 and CNT2 are operable each as a counter responsive to a clock or a frequency divided clock obtained from a clock source included in the external component 103. The counter region CNT1 is structured such that the count value is counted up if and when the same reaches a predetermined count value say "100" and the counter region CNT2 is structured such that the count value is counted up if and when the count value reaches a predetermined count value say "10". Meanwhile, the counter region CNT1 serves to determine a period T shown at (D) in FIG. 6 and the counter region CNT2 serves to determine the duration or the pulse width of the signal obtained from the control terminals U4, U5 and U6. At the step 1002 it is determined whether the counter region CNT1 has counted up the predetermined count value and, if and when it is determined that the counter region CNT1 has counted up the predetermined count value, then at the step 1003 the microprocessor resets or clears these counter regions CNT1 and CNT2. At the following step 1004 the microprocessor 101 determines whether there exists the data being outputted at the timing of the signal obtained at the control terminal U4. If and when such data is available, at the step 1005 the said data is obtained from the data terminal UD. Thereafter, at the step 1006 the control terminal U4 is set, as in the case where it is determined at the step 1004 that the data being outputted is not available. Accordingly, the signal obtained from the control terminal U4 is forced to the high level or the logic one from that timing. Then, in order to control the duration period t, it is determined at the following step 1007 whether the counter region CNT2 has counted up the predetermined count value. If and when the counter region CNT2 has counted up the predetermined count value, then at the following step 1008 the control terminal U4 is reset and at the same time the data output obtained from the data terminal UD is turned off at the step 1009. Then at the step 1010 the counter region CNT2 is reset or cleared. Then at the step 1011 the microprocessor 101 determines whether there exists the data being outputted in synchronism with the signal obtained from the control terminal U5. If and when such data is available, then at the step 1012 the said data is outputted from the data terminal UD, and if and when such data is not available, then the operation proceeds to the following step 1013. At the step 1013 the control terminal U5 is set. Accordingly, at that time the signal of the control terminal U5 as shown as (E) in FIG. 6 is brought to the high level or the logic one. Thereafter, if and when it is detected at the step 1014 that the counter region CNT2 has counted up the predetermined count value, then the control terminal U5 is reset at the step 1015 and at the same time the data terminal UD is again turned off at the step 1016 and the counter region CNT2 is cleared at the step 1017. At the following step 1018 the microprocessor 101 determines whether there exists the data being outputed in synchronism with the signal obtained from the control terminal U6. If such data is available, then at the step 1019 the said data is obtained at the data terminal UD, whereas if such data is not available, then the operation proceeds to the following step 1020. At the following step 1020 the control terminal U6 is set. Accordingly, at that timing the signal as shown as (F) in FIG. 6 becomes the high level or the logic one. If it is determined at the following step 1021 that the counter region CNT2 has counted up the predetermined count value, then at the following step 1022 the control terminal U6 is reset and at the step 1023 the data terminal UD is turned off. Thus the microprocessor 101 provides at the data terminal UD, the data corresponding to the control terminals U4, U5 and U6. If and when the signals are obtained at the control terminals U1', U2' and U3' of the microprocessor 201 in coincidence, then the data obtained from the data terminal UD is applied at that timing through the multiplexer 115 to the data terminal UD' of the microprocessor 201, as described previously.

Then at the step 1024 the microprocessor 101 controls the control terminals U7 and U8 described previously for controlling the external storage 105 and at the step 1025 performs the processing operation of the system. Then the operation returns again to "START".

Now referring to FIG. 8, an operation of the microprocessor 201 will be described. The microprocessor 201 controls the display 15 at the step 1031 until the signal obtainable at the control terminal U1' as shown as (I) in FIG. 6 is outputted. On the other hand, although not shown, the microprocessor 201 also comprises a random-access memory, wherein first and second counter regions CNT1' and CNT2', not shown, are formed in predetermined regions. The counter region CNT1' corresponds to the counter region CNT1 of the microprocessor 101 described previously and is used to determine the time period T' shown in FIG. 6. The counter region CNT2' corresponds to the counter region CNT2 and is used to determine the duration or the pulse width t' of the high level or the logic one of the signal obtainable from the control terminal. It is pointed out that out of a pair of the time periods T and T' and a pair of the time periods t and t' time periods T and T' of at least one pair are selected to be different from each other. At the step 1032 the microprocessor 201 determines whether the counter region CNT1' has counted up a predetermined count value. If and when the counter region CNT1' has counted up the predetermined count value, then the microprocessor 201 resets or clears the counter regions CNT1' and CNT2' at the step 1033. At the following step 1034 the microprocessor 201 sets the control terminal U1'. Accordingly, at that timing the signal as shown as (I) in FIG. 6 is forced to the high level or the logic one. At the following step 1035, if and when the data is available at the data terminal UD', then the data is read in. The microprocessor 201 then determines at the following step 1036 whether the counter region CNT2' has counted up the predetermined count value. The decision that the counter region CNT2' has counted up the predetermined value means that the time period t' has lapsed and the microprocessor 201 resets the control terminal U1' and resets or clears the counter region CNT2' at the steps 1037 and 1038. Then the microprocessor 201 sets the control terminal U2' at the step 1039. Accordingly, at that timing the signal as shown as (J) in FIG. 6 becomes the high level or the logic one. The microprocessor 201 reads the data at the following step 1040, if and when such is available at the data terminal UD'. If and when it is determined at the step 1041 that the counter region CNT2' has counted up the predetermined count value, then the control terminal U2' is reset at the step 1042 and at the step 1043 the counter region CNT2' is cleared. At the following step 1044 the microprocessor 201 sets the control terminal U3'. Accordingly, at that timing the signal shown as (K) in FIG. 6 becomes the high level or the logic one. If and when the data is available at the data terminal UD' at the following step 1045, then such data is read in and at the following step 1046 it is determined whether the counter region CNT2' has counted up the predetermined count value. If and when the counter region CNT2' has counted up the predetermined count value, then the control terminal U3' is reset. Thus, the microprocessor 201 forces in succession the control terminals U1', U2' and U3' to the high level or the logic one and the data obtainable at the data terminal UD' at that time is read in. At that time the AND gates 121, 123 and 125 each detect coincidence of the signals obtained at the control terminals U1', U2' and U3' and the control terminals U4, U5 and U6 of the microprocessor 101, respectively, and only at that timing the data obtained from the data terminal UD of the microprocessor 101 is applied to the data terminal UD', as described previously.

The microprocessor 201 further determines at the following step 1048 whether the apparatus is presently operating. Decision as to whether the apparatus is in operation is determined based on whether the START key is operated or not. If and when it is determined that the apparatus is operating, then at the following step 1049 the microwave generating portion 301 is controlled based on various types of control parameters such as a temperature, a time period and the like and the cooking condition data as entered from a microprocessor 101. At the step 1050 the microprocessor 201 makes a corresponding processing operation with respect to the previously read data, whereupon the operation returns again to "START".

Meanwhile, it is pointed out that the time periods T and T' shown in FIG. 6 have been selected to be longer than the longest time period required for execution of the corresponding programs, i.e. the programs shown in FIGS. 7 and 8, whereby fluctuation of the time periods T and T' is eliminated. More specifically, it is necessary to achieve a situation in which the counter region CNT1 has not yet counted up the predetermined count value, when it is determined at the step 1002 whether the counter region CNT1 has counted up the predetermined count value, after the step 1025 shown in FIG. 7, for example, is executed and then the program is caused to return again to "START". Unless such situation is established, the time period T (and T') fluctuates.

From the foregoing description, it would be appreciated that transmission of the data from the microprocessor 101 to the microprocessor 201 is made in accordance with the timing chart shown in FIG. 6, for example. Now in the following several examples will be described in which controls are made based on set specific cooking conditions.

I. A case where a heat cooking operation is performed with the output of 70% of the maximum output for a time period of one minute thirty seconds.

In this case, the following key entry is made using the keyboard or the operation portion 14.

[COOK] [7] [0] [TIME] [1] [3] [0] [START]

If and when the COOK key is operated, a four-bit binary code, say "0110" representing the COOK key is applied from the key matrix 111 and thus from the encoder 113 to the decoder terminal MD3 of the multiplexer 115 at the timing when the signal of the high level or the logic one is obtained at the control terminal U3 of the microprocessor 101. At that time the signal obtainable from the control terminal U3 is also applied to the OR gate 119 and therefore the multiplexer 115 receives the signal at the control terminal M1 at that timing. Accordingly the data terminals MD3 and MD1 are connected in the multiplexer 115. Therefore, the binary code "0110" applied to the data terminal MD3 at that time is applied through the multiplexer 115 to the data terminal UD of the microprocessor 101. Thereafter, insofar as the COOK key is manually operated, the binary code "0110" is received at the data terminal UD of the microprocessor each time the signal is obtained from the control terminal U3; however the microporcessor 101 is responsive to only the first binary code, without detecting any further binary code.

Thereafter the numeral "7" key is operated. However, after the COOK key is operated and before the numeral "7" key is operated, there occurs a short time period in which no keys are operated. During the above described non-keying time period, the microprocessor 101 continually provides the signals from the control terminals U1, U2 and U3 after the manual operation of the COOK key is released. At the first cycle thereof, a non-keying operation is confirmed. If and when no keying operation is made, the data is outputted responsive to the signals from the control terminals U4, U5 and U6. More specifically, the microprocessor 101 transfers the data of the key connected to the column line L1 of the key matrix 111 obtained from the control terminal U1 in synchronism with the signal obtained from the control terminal U4. Likewise, the microprocessor 101 is also adapted such that the same transfers the key data detected at the timing of the control terminal U2, i.e. the data obtained from the key connected to the column line L2 in synchronism with the signal obtained from the control terminal U5 and transfers the key data obtained when the signal from the control terminal U3 is outputted, i.e. the data obtained from the key connected to the column line L3 in synchronism with the signal from the control terminal U6. Accordingly, the microprocessor 101 provides the binary code "0110" received previously in synchronism with the signal obtained from the control terminal U3 at the data terminal in synchronism with the signal obtained from the control terminal U6. On the other hand, at that time the microprocessor 201 provides in succession the synchronizing signals or the scanning signals from the control terminals U1', U2' and U3', as described previously. Upon coincidence of the signal from the control terminal U6 and the signal from the control terminal U3', the signal is applied at that timing from the AND gate 125 through the OR gate 127 to the control terminal M2 of the multiplexer 115. Accordingly, in such synchronization of the signals from the control terminals U6 and U3', the binary code "0110" obtained from the data terminal UD is applied to the data terminal UD' of the microprocessor 201. The microprocessor 201 can recognize that the binary code "0110" is for the COOK key, through reception of the binary code "0110" from the data terminal UD' in synchronism with the signal from the control terminal U3'. Such data transmission from the microprocessor 101 to the microprocessor 201 is made through enablement of any one of the corresponding AND gates among the AND gates 121, 123 and 125; however, the microprocessor 201 only detects the first transmitted data and does not detect any further data.

After the lapse of the predetermined time period (the shortest time period required after the release of the keying operation until initiation of the next keying operation, for example) since receipt of such data (the binary code "0110"), the microprocessor 201 newly detects the data received at the data terminal UD'. On the other hand, the microprocessor 101 terminates or turns off the data output obtainable from the data terminal UD after the lapse of the above described predetermined time period, thereby to be ready for detection of the binary code corresponding to the next keying operation.

If and when the numeral "7" key is manually operated in the keyboard or the operation portion 14, the microprocessor 201 receives the binary code "0011" (corresponding to the numeral "7" key) being applied to the data terminal UD' in synchronism with the signal obtained from the control terminal U1' in accordance with the same operation as previously described. Likewise, when the numeral "0" key, the TIME key and the numeral "1" key, the numeral "3" key, the numeral "0" key and the START key are operated thereafter, the microprocessor 201 receives in succession the binary codes representing the corresponding keys. The microprocessor 201 is responsive to the entered binary codes to control the display 15. At that step the display 15 is controlled such that upon receipt of the binary code for the COOK key the bar segment **153*d* shown in FIG. 4 is enabled to emit light, whereupon the following numerical value represents the output in terms of percentage (%). When the numeral "7" key is operated and the microprocessor 201 receives the binary code "0011" corresponding to the key, the numeral display portion 151*a* of the first digit position is enabled to display the numeral "7". Then the microprocessor 201 reads the binary code corresponding to the numeral "0" key, and the display 15 displays the numerical value "70". Upon receipt of the binary code corresponding to the TIME key, the microprocessor 201 enables the bar segment 153*e* to emit light in the display 15. Light emission of the bar segment 153*e* indicates that the following numerical value is a time period. Upon entry of the numerical value "130", the numerical value "1:30" is displayed in the numeral display portion 151**.

Meanwhile, it is pointed out that in the above described operation, a time period required for a keying operation and a time period after release of a keying operation until the next keying operation are extremely longer as compared with the periods of the signals obtained from the control terminals U1 and U6 and U1' and U3'. Accordingly, the AND gates 121, 123 and 125 necessarily provide the outputs several tens of times even during the shortest time period required after release of a keying operation until initiation of the next keying operation. Such operation is the same in the following description as well.

The microprocessor 201 then controls the microwave generating portion 301. Before starting generation of a microwave, the microprocessor 201 is responsive to the binary code corresponding to the START key to detect whether the door 13 (FIG. 1) has been closed or not based on the signal obtained from the input terminal IC1. If and when a signal is obtainable at the input terminal IC1, it is determined that the door 13 has been closed and thereafter a control signal is obtained at the output terminals OP and OM so that the microwave generating portion is driven to provide an output of 70% of the maximum output. An operation time period has been set as one minute thirty seconds and after the lapse of one minute thirty seconds the signal is not obtained from the output terminal OM any more, whereby the microwave generating portion 301 is disabled.

Now consider a case where the STOP key is operated in the course of the above described cooking operation. In such a case, the binary code corresponding to the STOP key is read from the data terminal UD' in synchronism with the signal obtained at the control terminal U2', for example. If and when the binary code corresponding to the STOP key is read, the microprocessor 201 turns off the signal obtainable at the output terminal OM, whereby the heat cooking operation is midway terminated. If and when the START key is operated again, the microprocessor 201 receives the binary code corresponding to the START key, whereby a heat cooking operation is restarted. In the event that the CLEAR key is operated in the course of such cooking operation, the data applied to the microprocessor 201 is all cleared, so that any further cooking operation is disabled. Even if any keys other than the STOP key and the CLEAR key are operated in the course of such cooking operation, such keying operation is disregarded, whereby the above described cooking operation is continued.

II. A case where a heat cooking operation is performed with the maximum output until a temperature of a material being cooked becomes 155° F.:

In this case the following keying operation is made by means of the key board or the operation portion 14.

[TEMP] [1] [5] [5] [START]

Accordingly, the microprocessor 201 reads the binary code corresponding to the TEMP key obtained from the data terminal UD', when the signal is obtained from the control terminal U2' in synchronism with the signal of the control terminal of the microprocessor 101. Likewise, the binary codes corresponding to the numeral "1" key and the numeral "5" key and the numeral "5" key are read from the data terminal UD' responsive to the signals obtained from the control terminals U1' and U2' and U2', respectively. The binary code corresponding to the START key is read in synchronism with the signal obtained from the control terminal U1'. In executing such an operation, the microprocessor 201 checks the input terminals IC1 and IC2 to determine whether the door 13 has been closed and whether the temperature measuring probe 20 has been connected. After the signals are obtained from both of the input terminals IC1 and IC2, a control signal for controlling the microwave generating portion 301 is obtained for the first time. If and when no signal is obtained at the input terminal IC2, such situation is notified by energizing the buzzer 207. Since the operation mode in discussion is a temperature operation, the microprocessor 201 provides from the output terminals OT1 to OT4 the binary codes which are changeable in succession and, if and when the signal is obtained from the input terminal IT, the binary code obtained at that time is detected as a temperature of a material being cooked, not shown. Accordingly, if and when the detected temperature reaches a preset temperature (155° F. in this case), then the signal obtained from the output terminals OM and OP is turned off. Thus, a temperature operation is performed.

III. A case where the cooking number #15 is designated and the cooking program of the designated number is read out and is executed:

In this case, the following keying operation is made using the key board 14.

RECIPE 1 5 START

Accordingly, the microprocessor 101 is responsive to the signal obtained from the control terminal U3 to detect the binary code corresponding to the RECIPE key obtained at the data terminal UD. Then the microprocessor 101 detects in succession the binary code corresponding to the numeral "1" key in synchronism with the signal obtained from the control terminal U1 and the binary code corresponding to the numeral "5" key in synchronism with the signal obtained from the control terminal U2. The data detected by the microprocessor 101 is read in from the data terminal UD' of the microprocessor 201 in synchronism with the signals obtained at the control terminals U6, U4 and U5 and in synchronism with the signals obtained at the control terminals U3', U1' and U2'. Accordingly, the microprocessor 201 energizes the bar segment 152*a* in the display 15 and also displays the numerical value "15". Accordingly, an operator can confirm whether the cooking number designated by him is proper through a look at the display.

On the other hand, since the fixed cooking program of the cooking number #15 is stored in the read only memory 107 of the external storage 105, the microprocessor 101 is responsive to the signal obtained from the control terminal U7 to designate the read only memory 107, when the above described data is entered. If and when the signal is obtained from the control terminal U7, the said signal is applied through the OR gate 117 to the control terminal M3 of the multiplexer 115. Accordingly, at that timing the data terminals MD4 and MD1 are connected. The microprocessor 101 provides an addressing signal to the address terminal RA1 of the read only 107 memory from the address terminal UA in synchronism with the signal obtained from the control terminal U7 for addressing in succession one by one the addresses storing the cooking program of cooking number #15 such as from the address number one to the address number 15. Accordingly, the data of the program as stored is read in succession from one address to one address from the read only memory 107 and is entered in the microprocessor 101 through the multiplexer 115. More specifically, assuming that the fixed cooking program of cooking number #15, for example, is a cooking condition as shown in the above described cooking operation example I, then each time the signal is obtained from the control terminal U7 the data is read out from the read only memory 107 in succession as a series of the binary codes "0110", "0011", "0100", and so on. These binary codes as well as information representing in which column line of the key matrix 111 each binary code corresponds to are read out from the read only memory 107. For example, if and when the first binary code "0110" is read out, at the same time the information U3, for example, is also read out in order to indicate that the said first binary code corresponds to the code of the COOK key connected to the column line L3. Assuming that the code corresponding to the START key is in the address number 8, for example, among the addresses storing the cooking program of the cooking number #15 of the read only memory 107, then the microprocessor 101 is responsive to the code corresponding to the START key to stop addressing from any further address terminal UA. The cooking program data as read from the read only memory 107 is outputted from the data terminal UD and is transferred to the data terminal UD' of the microprocessor 201 in synchronism with the signals obtained from the control terminals U4, U5 and U6.

Each time the microprocessor 201 receives the above described cooking program data from the microprocessor 101, the microprocessor 201 provides a confirmation signal to the microprocessor 101 through a suitable signal line, not shown. The microprocessor 101 is responsive to receipt of the confirmation signal to transfer the next data. Likewise thereafter transfer of the cooking program data is effected and finally the binary code corresponding to the START key is obtained from the microprocessor 101 and upon receipt of the confirmation signal the microprocessor 101 awaits a further keying operation. Meanwhile, when the microprocessor 201 receives the binary code corresponding to the START key, immediately such a cooking operation as the previously described cooking example I is executed.

In a case where it is desired to designate such fixed cooking program and to change a cooking time period in association with the weight of a material being cooked, it is sufficient to make the following keying operation by means of the keyboard 14.

RECIPE 1 5 MULTI 2 START

In the case where such keying operation is made, the microprocessor 201 reads the data in the read only memory 107 in the manner described previously; however, the microprocessor 101 is responsive to an operation of the MULTI key to determine that it is necessary to modify a cooking time period of the read fixed cooking program such as one minute thirty second. Since the numeral "2+ key is operated following the keying operation of the MULTI key, in such a case the microprocessor 101 multiplies the cooking time period by two to obtain three minutes and the modified cooking time period as well as other control data is applied to the microprocessor 201. Accordingly, in such a case the microprocessor 201 controls the microwave generating portion 301 so that a heat cooking operation is performed for three minutes with the output of 70% of the maximum output.

In a case where a cooking operation is made in accordance with the above described fixed cooking program, the same also applies in a case where the fixed cooking program of the cooking number say #21 to #40 stored in the random-access memory 109 is read and is executed.

IV. A case where the cooking program of the operation example I is stored as cooking number #30:

In such a case the following keying operation is made using the operation portion or the key board 14.

[WRITE] [RECIPE] [3] [0] [COOK] [7] [0]

[TIME] [1] [3] [0] [START]

Accordingly, the microcomputer 201 receives the binary code corresponding to the WRITE key in synchronism with the signal obtained at the control terminal U1', receives the binary code corresponding to the RECIPE key in synchronism with the signal obtained at the control terminal U3' and likewise thereafter receives the binary codes corresponding to the operated keys in succession at the corresponding timings. Upon receipt of the binary code corresponding to the WRITE key, the microprocessor 201 energizes the bar segment 152*c* of the display 15, thereby to indicate that the further control is a writing operation of a fixed cooking program in the random-access memory 109. At the same time, the bar segment 152*a* of the display 15 is also energized, thereby to indicate that the following numerals are for the cooking number. Then the bar segment 153*d* of the display 15 is energized, thereby to indicate that the following numerical value is for the output in terms of percentage (%). Furthermore, the bar segment 153*e* of the display 15 is energized, thereby to indicate that the following numerical value is for a timer time period. Meanwhile, the numerical values are displayed in succession such as "30", "70" and "1:30". Accordingly, an operator can confirm his own keying operation through a look at the display 15.

After the data is thus entered, the microprocessor 101 writes the cooking program as shown in the operation example I in the random-access memory 109 based on the entered data. More specifically, the microprocessor 101 provides the signal from the control terminal U8 to designate the random-access memory 109. The multiplexer 115 is responsive to the signal obtained at the control terminal U8 to make connection between the data terminals MD4 and MD1. The microprocessor 101 is then responsive to the signal from the address terminal UA to address in succession one by one the addresses, say the address number 15 to the address number 30 of the random-access memory 109 storing the cooking program of the cooking number #30 in synchronism with the signal obtained from the control terminal U8, thereby to read the data therefrom. Thus, the microprocessor 101 provides the respective data in accordance with the addressing responsive to the signal from the address terminal UA in synchronism with the signal obtained from the control terminal U8, i.e. provides the binary code corresponding to the COOK key, the binary code corresponding to the numeral "7" key, and the binary code corresponding to the numeral "0" key, and so on such as "0110", "0011" and "0100", and so on. At that time the information representing to which column line the key for the code is connected in the key matrix 111 is also obtained with respect to each of the binary codes. If and when the binary code corresponding to the START key is written in the address number 23, for example, of the random-access memory 109, then the microprocessor 101 is placed in a condition for awaiting a further keying operation. V. A case where the cooking program stored in the cooking number #35 is released:

In such a case the following keying operation is made using the keyboard 14.

[RECIPE] [3] [5] [CLEAR]

Accordingly, the microprocessor 101 receives the binary code corresponding to the RECIPE key in synchronism with the signal obtained from the control terminal U3, the binary code corresponding to the numeral "3" key in synchronism with the signal obtained from the control terminal U3, the binary code corresponding to the numeral "5" key in synchronism with the signal obtained from the control terminal U2, and finally the binary code corresponding to the CLEAR key in synchronism with the signal obtained from the control terminal U3. The data thus entered is transferred from the microprocessor 101 through the multiplexer 115 to the microprocessor 201 in synchronism with the corresponding signals of the control terminals U4, U5 and U6. Accordingly, the microprocessor 201 energizes the bar segment 152*a* of the display 15, thereby to indicate that the following numerical value is the cooking number. Then the display 15 displays the numerical value "35".

Upon receipt of the above described data, the microprocessor 101 makes a processing or controlling operation for releasing the cooking program of the cooking member #35 stored in the random-access memory 109. More specifically, assuming that the cooking program of the cooking number #35 has been stored in the addresses numbers 41 to 55 of the random-access memory 109, the microprocessor 101 addresses in succession one by one the addresses in synchronism with the signal obtained from the control terminal U8 responsive to the signal obtained from the address terminal UA. At that time the signal of the logic zero is obtained at the data terminal UD. Then the logic zero is written in all the addresses numbers 41 to 55 of the random-access memory 109, with the result that the cooking program of #35 is released.

Figure 9:
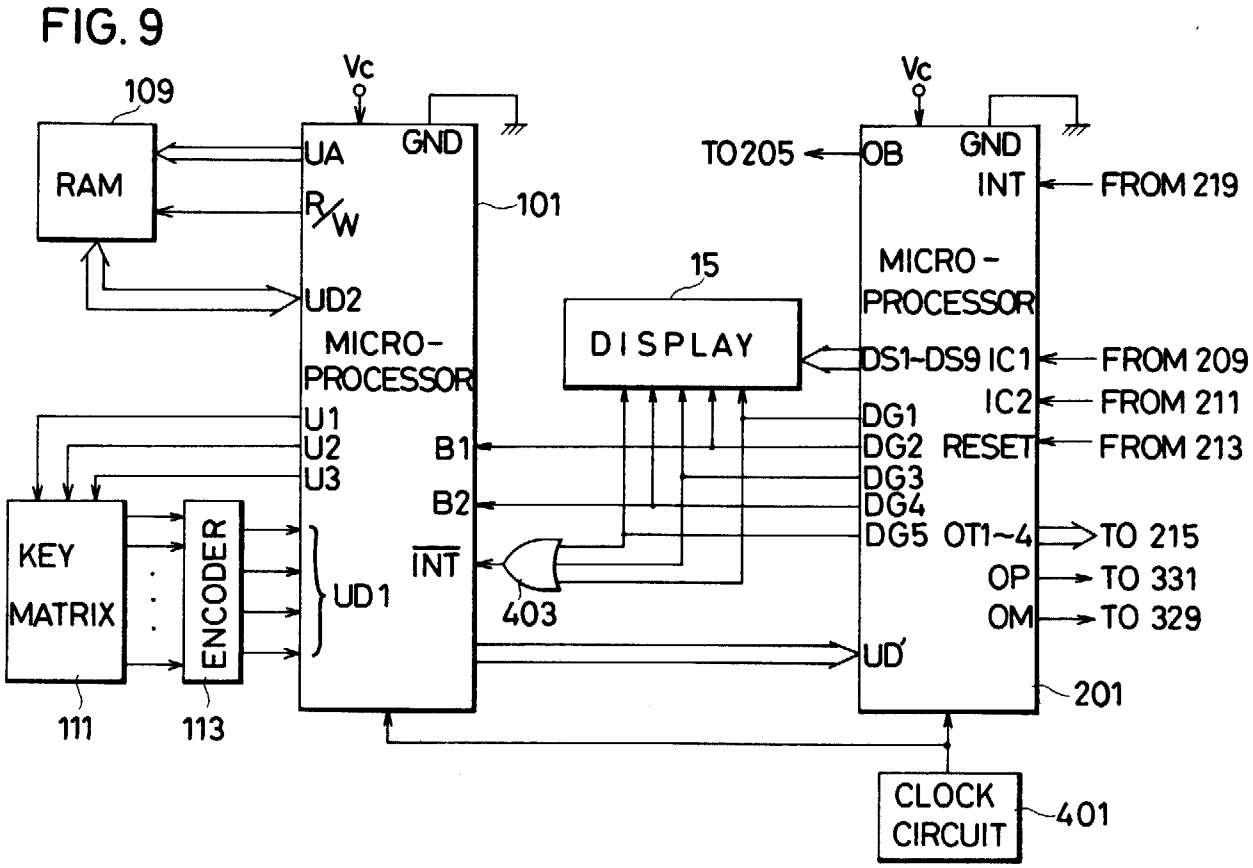
FIG. 9 is a block diagram showing another preferred embodiment of the present invention.

FIG. 9 is a block diagram showing another preferred embodiment of the present invention. Whereas the previously described FIG. 2 embodiment required the gate circuit coupled to the multiplexer 115 for transmission and reception of the data, the FIG. 9 embodiment has a simplified structure for omission of such gate circuit. Meanwhile, in the FIG. 9 embodiment the same portions as those of the FIG. 2 embodiment have been denoted by the same reference characters and a detailed description thereof will be omitted. The FIG. 9 embodiment comprises only the random-access memory 109 as the external storage 105. Meanwhile, in the FIG. 9 embodiment a read only memory corresponding to the read only memory 107 of the FIG. 2 embodiment is implemented as a portion of a read only memory, not shown, included in the microprocessor 101. In the FIG. 9 embodiment the data obtained from the key matrix 111, i.e. the data obtained from the encoder 113 is directly applied to the data terminal UD1 of the microprocessor 101. A common clock source 401 is provided for these two microprocessors 101 and 201.

The characteristic features of the FIG. 9 embodiment reside in that the three signals DG1, DG3 and DG5 out of the digit selecting signals DG1 to DG5 for the display 15 obtained from the microprocessor 201 are used to exert interruption from the microprocessor 201 to the microprocessor 101, so that the data necessary for control of the cooking operation is transferred from the microprocessor 101 to the microprocessor 201 in association with the interruption. To that end, an OR gate 403 is provided for receiving the signals DG1, DG3 and DG5 and the output of the OR gate 403 is applied to an interrupt terminal $\overline{INT}$ of the microprocessor 101. Now that the structural features of the FIG. 9 embodiment were described, in the following an operation of the FIG. 9 embodiment will be described with reference to the timing chart shown in FIG. 10 and the flow diagrams shown in FIGS. 11 to 18.

Referring to the FIG. 10 timing chart, an outline of the operation of the FIG. 9 embodiment will be described. The microprocessor 201 is responsive to the clock from the clock circuit 401 to provide the digit selecting signals DG1 to DG5 for the display 15 shown as (A) to (E) in FIG. 10, respectively. Out of these digit selecting signals, the signals DG1, DG3 and DG5 are applied through the OR gate 403 to the interrupt terminal $\overline{INT}$ of the microprocessor 101. Accordingly, the interrupt terminal $\overline{INT}$ of the microprocessor 101 receives an interrupt signal as shown as (F) in FIG. 10. The microprocessor 101 is responsive to the fall of the interrupt signal to provide any of the data applied from the key matrix 111 through the key encoder 113 to the data terminal UD1, the data applied from the random-access memory 109 of the external storage to the data terminal UD2, or the data as read from the read only memory (included in the microprocessor 101), not shown, to the data terminal UD' of the microprocessor 201. Accordingly, during the following digit signal period, the microprocessor 201 receives the data thus applied to the data terminal UD'. Such manner is shown as (G), (H) and (I) in FIG. 10, wherein the hatched portion shows a time period when the data obtained at the data terminal UD' is read by the microprocessor 201. As understood from the FIG. 10 timing chart, the leading edge of the digit selecting signal DG2 is advanced as compared with the trailing edge of the preceding digit signal DG1 and likewise the leading edge of the digit selecting signal DG4 is advanced as compared with the trailing edge of the preceding signal DG3. The reason why an overlap is provided between the signals DG1 and DG2 and between the signals DG3 and DG4 is that although the data is obtained at the data terminal UD' of the microprocessor 201 responsive to the signal being applied to the interrupt terminal $\overline{INT}$ from the microprocessor 201, it is necessary to identify in which timing the interruption occurred.

More specifically, as in the case of the previously described embodiment, the microprocessor 201 identifies which key the data corresponds to by discriminating which column line key in the FIG. 5 key matrix the binary code corresponds to based on at what timing the data is obtained at the data terminal UD'. Accordingly, it is necessary that the microprocessor 101 provides the binary code to the data terminal UD' at a particular timing. For example, if and when it is desired to transfer the data concerning the COOK key from the microprocessor 101 to the microprocessor 201, it is necessary that the microprocessor 101 is responsive to the interruption operable at the fall of the digit selecting signal DG3 to provide the corresponding binary code. Then the microprocessor 201 reads the data obtained at the data terminal UD' at the digit selecting signal DG5 (corresponding to the signal obtained at the control terminal U3' of the previously described embodiment) and determines the binary code say "0110" as the data corresponding to the COOK key. In order that the microprocessor 101 recognizes the timing when the data is to be transferred, the signals DG1 and DG2 and the signals DG3 and DG4 are overlapped to each other.

Figure 11:
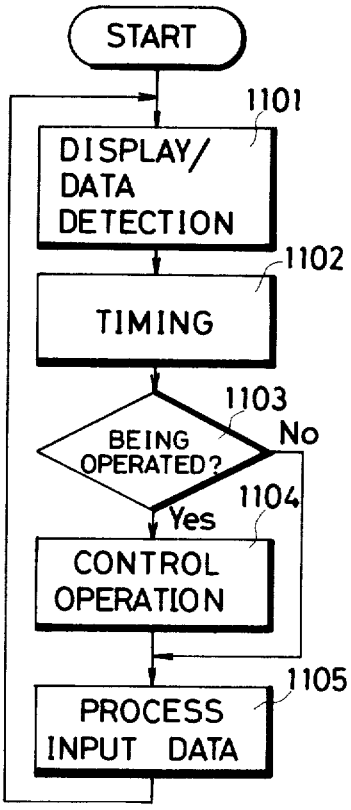
FIGS. 11 to 18 are flow diagrams for depicting an operation of the FIG. 9 embodiment.

Now referring to FIG. 11, an outline of an operation of the microprocessor 201 will be described. At the step 1101 the microprocessor 201 controls the display 15 and also detects the data obtained from the data terminal UD'. The detection is made in the manner described subsequently. At the following step 1102 the microprocessor 201 is responsive to the interrupt signal obtained from the circuit 219 (FIG. 2) to perform a timing operation. At the following step 1103 the microprocessor determines whether the apparatus is presently operating. If it is determined that the apparatus is operating, the processor 201 performs at the step 1104 a control for that operation based on the various control parameters and the provided cooking condition data. Then, as in the case where it is determined at the step 1103 that the apparatus is not operating, the microprocessor 201 performs at the following step 1105 a necessary processing operation on the data read from the data terminal UD'. One characteristic feature of the routine is the step 1101. As described previously, at the step 1101 the display 15 is controlled and at the same time the data obtained from the data terminal UD' is detected.

Figure 13:
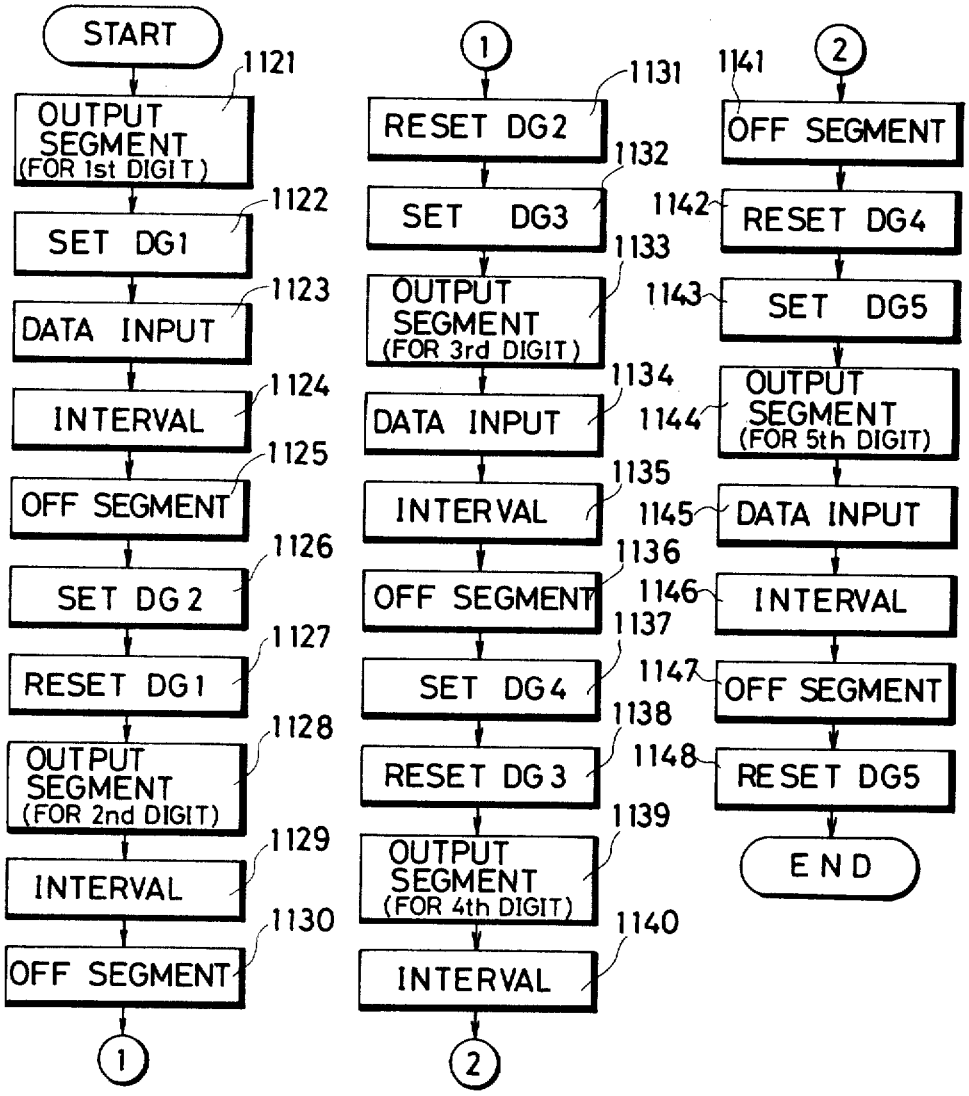

Now referring to FIG. 13, the contents in the step 1101 will be described in more detail. Referring to FIG. 13, at the first step 1121 the segment selecting signals DS1 to DS9 are outputted to the first digit position of the display 15. Then the digit selecting signal DG1 is set at the step 1122. Accordingly, at that timing the digit selecting signal DG1 is brought to the high level or the logic one, as shown as (A) in FIG. 10. Therefore, at that timing the microprocessor 201 receives at the step 1123 the data obtained at the data terminal UD'. At the step 1124 a slight duration time period is considered and at the following step 1125 the segment selecting signals DS1 to DS9 corresponding to the previous first digit position are turned off. Then the microprocessor 201 sets at the following step 1126 the digit selecting signal DG2. Accordingly, at that timing the digit selecting signal DG2 is brought to the high level or the logic one as shown as (B) in FIG. 10. It would be appreciated that since the digit selecting signal DG1 has not been reset at the timing, both digit selecting signals DG1 and DG2 are the high level or the logic one at that timing. Then after the lapse of a slight time period the microprocessor 201 resets at the step 1127 the preceding digit selecting signal DG1. Thus, the digit selecting signals DG1 and DG2 are overlapped. Then the microprocessor 201 provides at the step 1128 the segment selecting signals DS1 to DS9 to the second digit position of the display 15. Thereafter, these signals are outputted for a slight duration time period, through the step 1129, and at the step 1130 the segment selecting signals are turned off. At the same time the digit selecting signal DG2 is reset at the step 1131. At the following step 1132 the digit selecting signal DG3 is set. Accordingly, at that timing the digit selecting signal DG3 is brought to the high level or the logic one as shown as (C) in FIG. 10. Meanwhile, since the program has been adapted such that after the digit selecting signal DG2 is reset the digit selecting signal DG3 is set, no overlap occurs between these two digit selecting signals DG2 and DG3 as shown in FIG. 10. Meanwhile, it is pointed out that the steps 1132 to 1138 are for a control of the digit selecting signal DG3, the steps 1137 to 1142 are for a control of the digit selecting signal DG4 and the steps 1143 to 1148 are for a control of the digit selecting signal DG5. Although a description thereof is omitted, such would be readily understood with simultaneous reference to FIG. 13 as well as FIG. 10.

Figure 12:
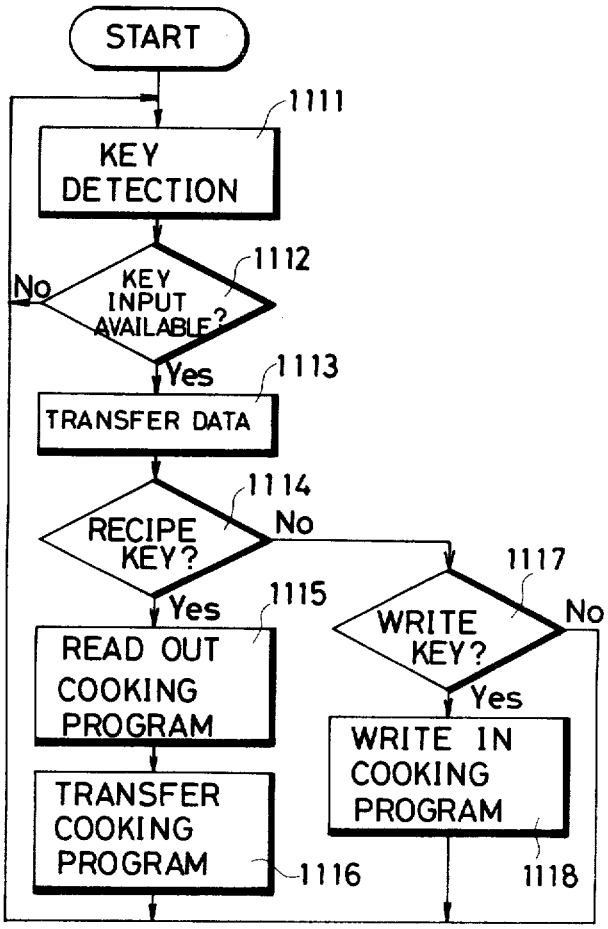

Now referring to FIG. 12, an outline of an operation of the microprocessor 101 will be described. At the step 1111 the microprocessor 101 detects a keying input operation by detecting the binary code obtained at the data terminal UD1. If and when it is determined at the following step 1112 that a keying input is detected, the entered data or the binary code corresponding to the operated key is transferred at the step 1113 to the data terminal UD' of the microprocessor 201 in the manner described previously. The above described data transmission step serves to display the entered cooking condition by the display 15. Then at the following step 1114 the microprocessor 101 determines whether the operated key is the RECIPE key. This step is aimed to determine whether the designated cooking condition is a fixed cooking program. If and when the RECIPE key has been operated, the microprocessor 101 reads at the following step 1115 a fixed cooking program stored in advance in the random-access memory 109 or in the read only memory included in the microprocessor 101. At the following step 1116 the read data of the fixed cooking program is transferred to the data terminal UD' of the microprocessor 201. If and when it is determined at the previous step 1114 that the RECIPE key has not been operated, then the microprocessor 101 detects at the following step 1117 whether the WRITE key has been operated. The step 1117 is aimed to detect whether the writing or setting of a fixed cooking program was commanded. If and when the WRITE key has been operated, the microprocessor 101 performs at the following step 1118 a processing or controlling operation for writing the cooking program in the random-access memory 109 based on the entered data. If and when it is determined at the step 1117 that the WRITE key has not been operated, the program returns again to "START" as in the case where the program proceeds through the step 1116 or 1118. The characteristic features of the FIG. 12 flow diagram are the steps 1113, 1115, 1116 and 1118. In the following, therefore, these steps will be described in succession in more detail with reference to the corresponding flow diagrams.

First referring to FIGS. 14A and 14B, the step 1113 of data transmission from the microprocessor 101 to the microprocessor 201 will be described in detail. First the microprocessor 101 sets at the step 1151 the entered key code. More specifically, the binary code received at the data terminal UD1 is converted into a binary code acceptable by the microprocessor 201. The binary code thus converted is temporarily stored in the output buffer, not shown, at the following step 1152. At that time, a flag FLA, FLB or FLC representing at which timing each of the binary code is to be transferred to the processor 201 is also stored. The flag FLA represents that the code is the data which is to be received by the microprocessor 201 at the timing of the digit selecting signal DG1, the flag FLB represents that the code is the data which is to be received by the microprocessor 201 at the timing of the digit selecting signal DG3 and the flag FLC represents that the code is the data which is to be received by the microprocessor 201 at the timing of the digit selecting signal DG5. Then at the step 1153 the microprocessor 101 is placed in an awaiting state or a standby state for awaiting interruption. At the step 1154 it is determined whether interruption was made based on the signal obtained at the interrupt terminal $\overline{\text{INT}}$. In the absence of interruption, the microprocessor 101 continues an awaiting state, and in the presence of interruption, the microprocessor 101 shifts at the step 1155 to the interruption subroutine (FIG. 14B). In executing the step 1155, at the outset at the step 1161 it is determined whether the flag FLD has been set. The flag FLD is a flag representing whether the data transmission is presently in progress from the microprocessor 101 to the microprocessor 201. Accordingly, if and when it is determined at the step 1161 that the flag FLD has been set, then at the following step 1162 the flag FLD is reset to be ready for the next data output. The microprocessor 101 sets the flag FLE at the following step 1163, thereby to process as the output completed. The flag FLE is a flag indicating that the output of the data transmission from the microprocessor 101 is completed. Accordingly, at the following step 1164 the data to the terminal UD' of the microprocessor 201 is turned off. Thereafter the program returns from this subroutine to the step 1156 of FIG. 14A.

Figure 10:
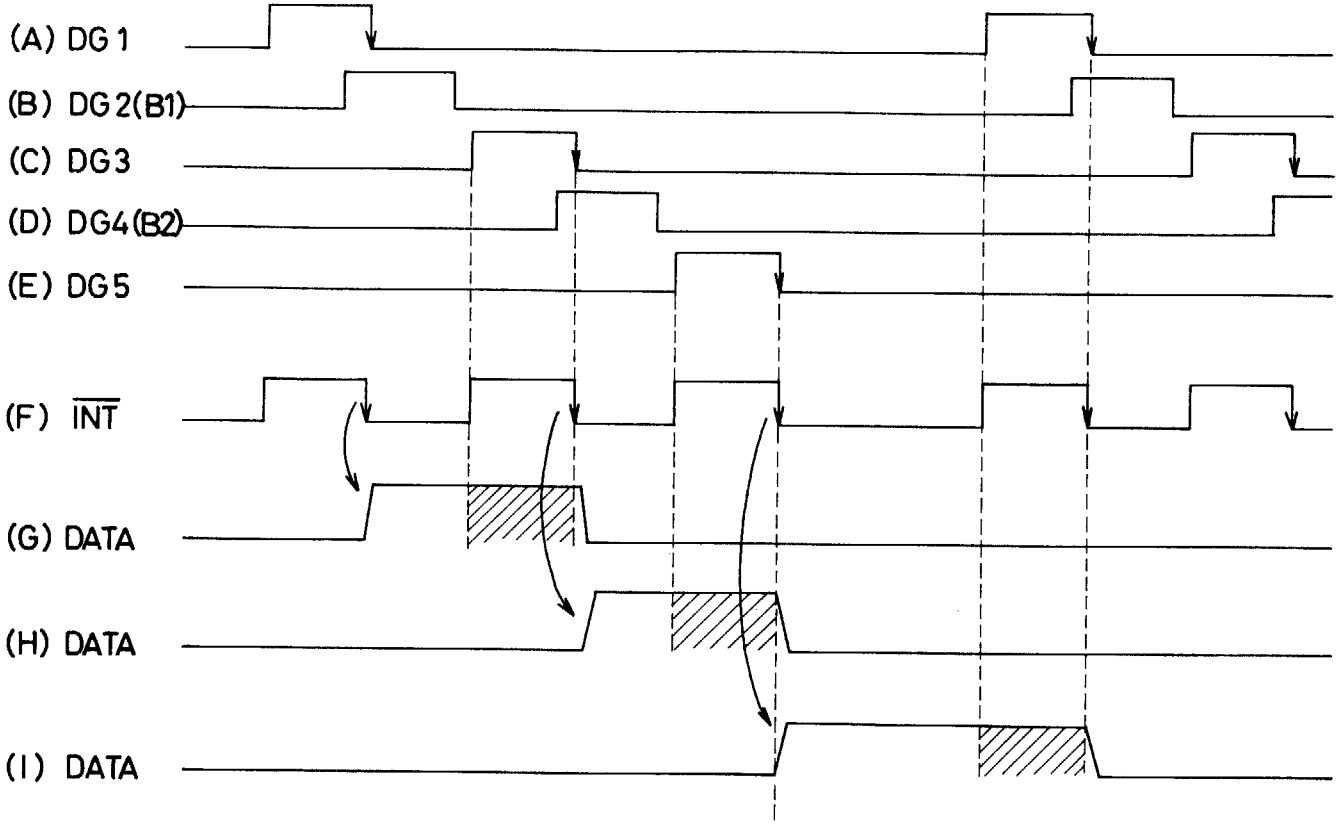
FIG. 10 is a timing chart for depicting an operation of FIG. 9 embodiment.

If and when it is determined at the first step 1161 of the subroutine that the flag FLD has not been set, or if and when the data transmission is not in progress from the microprocessor 101 to the microprocessor 201, then the microprocessor 101 determines at the following step 1165 whether the signal B1 (which corresponds to the digit selecting signal DG2 and is shown as (B) in FIG. 10) is the high level or the logic one.

If and when it is determined at the step 1165 that the signal B1 is the logic one, then the microprocessor 101 determines at the following step 1161 whether the data to be read by the microprocessor 201 at the timing of the digit selecting signal DG3 is available by referring to the flag FLB of the previously described output buffer, not shown. In the absence of the corresponding data, the program shifts to the previously described step 1164. In the presence of the corresponding data, the microprocessor 101 reads the corresponding data from the output buffer and provides the same at the step 1167 to the data terminal UD' of the miroprocessor 201. Then at the following step 1168 the flag FLD is set.

If and when it is determined at the previously described step 1165 that the signal B1 is not the logic one, then the microprocessor 101 determines at the step 1169 whether the signal B2 (which corresponds to the digit selecting signal DG4 and is shown as (D) in FIG. 10) is the high level or the logic one. If and when the signal B2 is the logic one, the microprocessor 101 checks the flag FLC of the output buffer to determine whether the data to be read by the microprocessor 201 at the timing of the digit selecting signal DG5 is available. In the presence of the corresponding data, the program shifts to the step 1167, whereas in the absence of the corresponding data the program shifts to the step 1164.

If and when it is determined at the step 1169 that the signal B2 is not the logic one, the microprocessor 101 checks at the following step 1171 the flag FLA of the output buffer to determine whether the data to be received by the microprocessor 201 at the timing of the digit selecting signal DG1 is available. In the presence of the corresponding data, the program shifts to the step 1167, whereas in the absence of the corresponding data the program shifts to the step 1164.

Figure 14A:
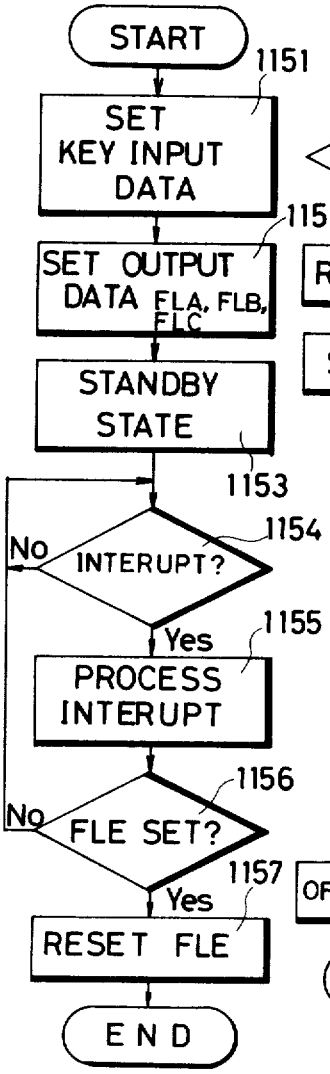
Figure 14B:
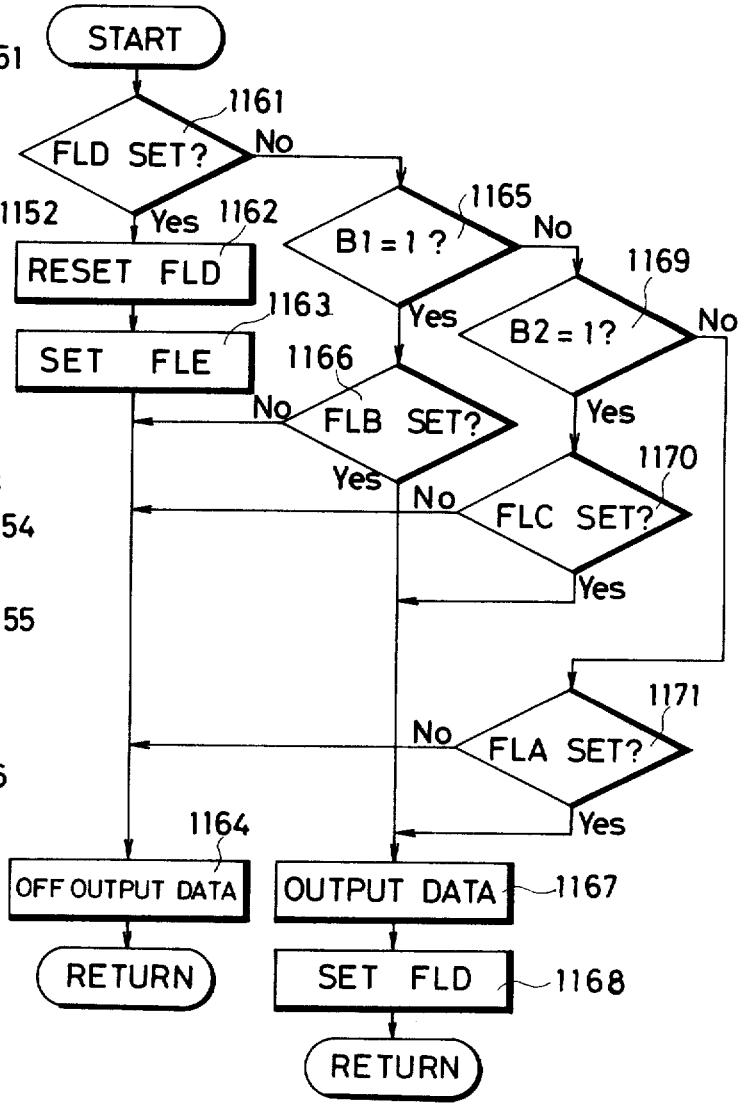

After the step 1164 or 1168, the program returns to the step 1156 shown in FIG. 14A. At the step 1156 the flag FLE is checked to determine whether the data output from the microprocessor 101 to the microprocessor 201 is completed. If and when the data output is not completed, the program returns to the previously described step 1154, whereas if and when the data output is completed, then at the following step 1157 the flag FLE is reset and the program returns to the step 1114 of FIG. 12.

Figure 15:
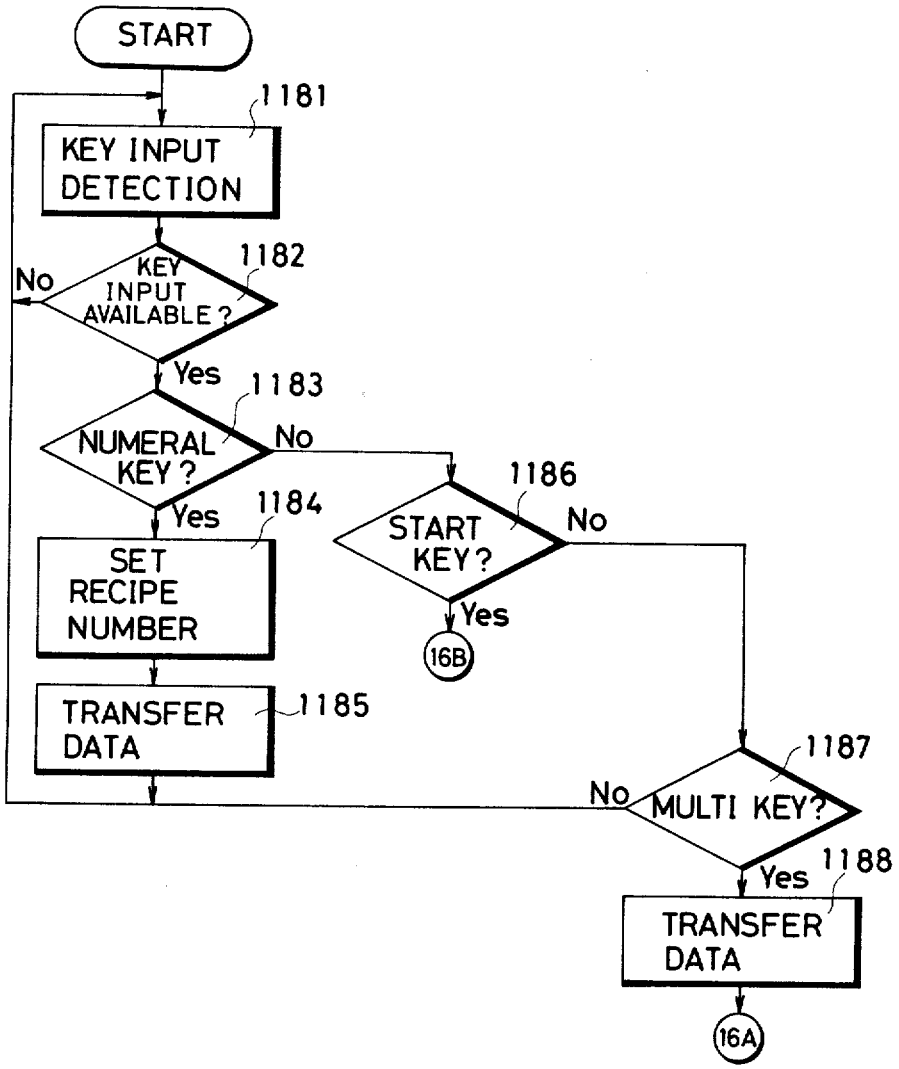
Figure 16A:
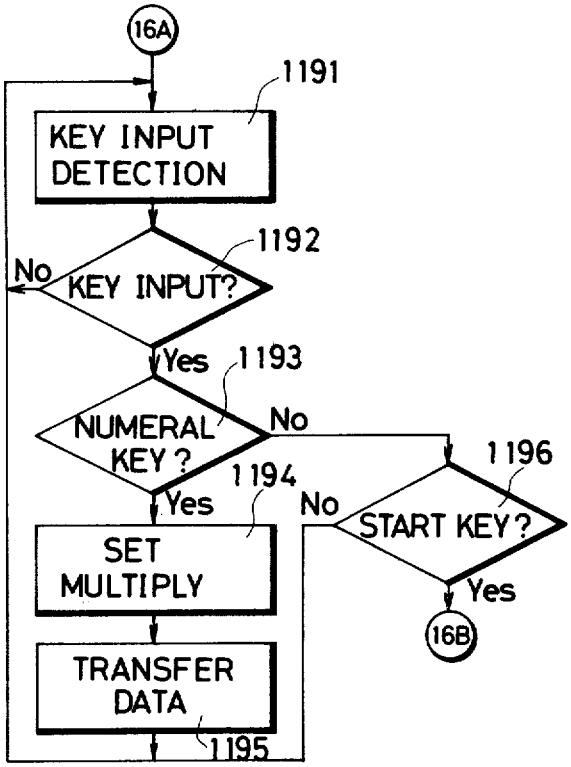
Figure 16B:
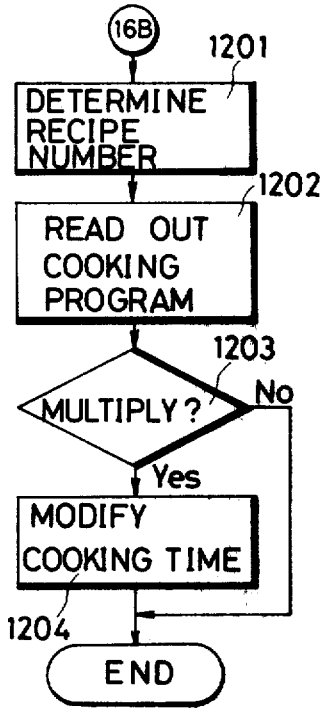

Now referring to FIG. 15, the subroutine of the step 1115 shown in FIG. 12 will be described. In such a case, at the first step 1181 the microprocessor 101 detects the keying input in the manner previously described to determine at the steps 1181 and 1182 whether the keying operation was made. If and when it is determined at the step 1182 that the keying input was made, then at the following step 1183 it is determined whether the entered binary code is of a numeral key. If and when it is determined that the entered binary code corresponds to a numeral key, this means that the same is the RECIPE # and the microprocessor 101 sets at the step 1184 the entered numerical value in the randomaccess memory, not shown. Then, as in the case of the step of data transmission as shown in FIGS. 14A and 14B, at the step 1185 the data is transferred to the microprocessor 201. This data transmission is effective to make confirmation of the RECIPE # by the display 15.

If and when it is determined at the step 1183 that the detected binary code does not represent a numerical value, then it is determined at the step 1186 whether the same corresponds to the START key. If and when it is determined at the step 1186 that the binary code does not correspond to the START key, then at the following step 1187 it is further determined whether the same is of the MULTI key. If and when the MULTI key has been operated, this means that the data concerning the weight of a material being cooked (a multiple with respect to a unit weight) is set. As in the case of the previously described step 1113 (FIG. 12) the binary code corresponding to the MULTI key is transferred to the microprocessor 201 at the step 1188. This data transmission is also effective to make confirmation by the display 15. After such data transmission, the microprocessor 101 shifts to the step 1191 shown in FIG. 16A. At the steps 1191 and 1192 the keying input operation is detected and at the step 1193 it is determined whether the same is a binary code corresponding to a numeral key. If and when it is determined that the same is a binary code corresponding to a numeral key, then this means that the same is the above described multiple and at the following step 1194 the said multiple is set in the random-access memory and at the following step 1195 the said multiple is transferred to the microprocessor 201.

If and when it is determined at the previously described step 1186 that the START key is operated or the same decision is made at the following step 1196, then the microprocessor 101 shifts to the following step 1201. At the step 1201 the microprocessor 101 determines based on the previously set RECIPE # whether the corresponding fixed cooking program is stored in the random-access memory 109 or whether the same is stored in the read only memory, not shown, included in the microprocessor 101 and at the following step the microprocessor 101 reads the corresponding fixed cooking program. At the following step 1203 it is determined whether the above described multiple has been set. More specifically, if and when it is determined at the previously described step 1187 that the MULTI key has been operated and if and when it is determined at the step 1194 that the multiple has been set, then it is determined at the step 1203 that the multiple has been entered and at the following step 1204 the data concerning a cooking time period of the fixed cooking program is modified in the manner previously described. Thereafter, as in the case where it is determined at the step 1203 that the multiple has not been entered, the program returns to the step 1116 shown in FIG. 12.

Figure 17:
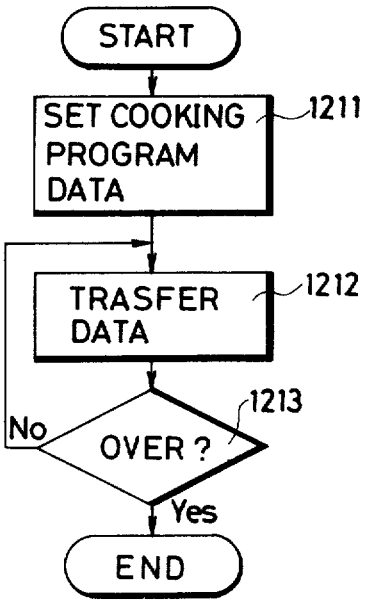

Now referring to FIG. 17, the step 1116 shown in FIG. 12 will be described. In such a case, at the first step 1211, as in the case of the step 1151 shown in FIG. 14A, the data of the previously read fixed cooking program is set in the output buffer, not shown. At that time, as in the case of the previously described step 1152 (FIG. 14A), the flag representing at which timing (at any one of the timings of the digit selecting signals DG1, DG3 and DG5) such data is to be received by the microprocessor 201 is also set in the output buffer. Then, as in the case of the previously described step 1113 (FIG. 12), the data transmission is made at the following step 1212. In the course of the above described data transmission, the microprocessor 101 determines at each transmission whether the data being transmitted from the microprocessor 101 to the microprocessor 201 has been left, based on the number of pieces of the data set in the output buffer. At the step 1213 it is determined whether the data transmission is completed and at the completion of the data transmission the program returns again to the step 1111 (FIG. 12).

Figure 18:
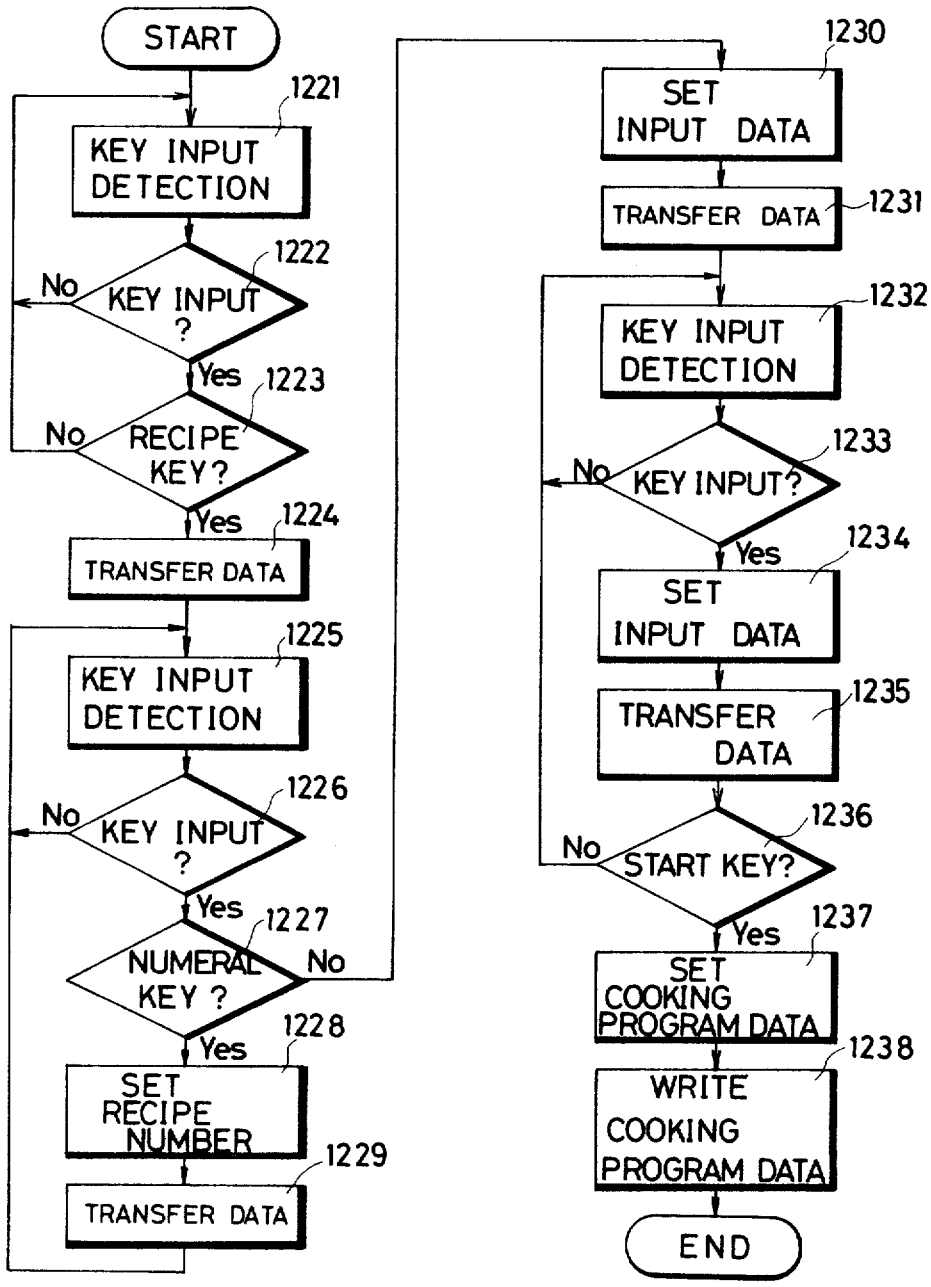

Now referring to FIG. 18, the step 1118 shown in FIG. 12 will be described in more detail. In executing the step 1118, at the first steps 1221 and 1222 the keying input operation is detected and then at the following step 1223 it is determined whether the keying input operation is of the RECIPE key. If and when it is determined at the step 1223 that the RECIPE key is operated, then the data is transferred at the step 1224 to the microprocessor 201, as in the previously described case. The data transmission is effective to make confirmation of the operation through a look at the display 15, as described previously. Then at the steps 1225 and 1226, the keying input operation is detected. Then at the step 1227, it is detected whether a numeral key is operated. If and when it is determined at the step 1227 that a numeral key has been operated, then the keying input operation is of the RECIPE # and at the step 1228 the same is stored or set in a predetermined region of the random-access memory, not shown, included in the microprocessor 101. The data thus set is transferred at the following step 1229 to the microprocessor 201, whereby the same is displayed in the display 15 to enable confirmation of the operation.

If and when it is determined at the step 1227 that a numeral key has not been operated, then this indicates that a function key other than the numeral keys was operated and the data is also stored or set in the same random-access memory, not shown, and is transferred to the microprocessor 201 at the steps 1230 and 1231. At the steps 1232 and 1233 the keying input operation is detected and likewise thereafter the entered data is stored in predetermined regions of the random access memory, not shown, and is also transferred to the microprocessor 201 at the steps 1234 and 1235. The data stored or set in the step 1230 and 1234 would be the data concerning a fixed cooking program being written, such as the output value in terms of the percentage (%), the temperature value, the cooking time period and the like. At the step 1236 the microprocessor 101 determines whether the START key is operated. If and when the START key has been operated, this means that all the data concerning a fixed cooking program being written has been keyed in and the microprocessor 101 sets at the following step 1237 the entered cooking program data and the data is written at the step 1238 in the predetermined regions of the random-access memory 109 included in the external storage 105 in the same manner as previously described. Upon completion of the writing, the program returns to the step of FIG. 12.

Although the foregoing the embodiments were described by taking examples employing two microprocessors, the number of microprocessors may be increased to employ a third and fourth microprocessors in the case where the load being controlled is increased or the number of fixed cooking programs is increased. In such a case transmission and reception of the data among the respective microprocessors can be made in accordance with either of the above described embodiments, as readily apparent to those skilled in the art, and hence a detailed description thereof will be omitted.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for controlling an electronic controlled cooking apparatus, comprising:

energy generating means for generating energy for cooking a material being cooked, entry means for providing data concerning cooking conditions being applied to said material being cooked, storage means for storing data concerning a fixed cooking condition corresponding to a specified one of the pieces of said cooking condition data being provided by said entry means, data display means for displaying at least said cooking condition data entered by said entry means, and control means responsive to at least one of said cooking condition data entered by said entry means and said fixed cooking condition data obtained from said storage means for controlling said energy generating means, said control means comprising at least two independently operable microprocessor means which cooperate with each other, data transmission means for providing a data transmission path between said two microprocessor means, at least one of said microprocessor means being adapted to detect said cooking condition data entered by said entry means, at least the other of said microprocessor means being responsive to the data received from said one microprocessor means to control said energy generating means and one of said two microprocessor means also for controlling said data display means to display the data received by said one microprocessor means, each of said at least two microprocessor means further comprising means for cyclically providing a separate individual synchronizing signal, coincidence detecting means for detecting coincidence of said synchronizing signals of said at least two microprocessor means, and said data transmission means being responsive to the output of said coincidence detecting means for directly transmitting data from said one microprocessor means to said other microprocessor means to be received thereby for controlling said energy generating means in accordance with the data entered into and transmitted from said one microprocessor means.

2. A control apparatus in accordance with claim 1, wherein said synchronizing signal of each of said two microprocessor means is selected to have a different generation cycle.

3. A control apparatus in accordance with claim 1, wherein said synchronizing signal of each of said two microprocessor means is selected to have a different duration.

4. A control apparatus in accordance with claim 1 wherein said data transmission means comprises:

multiplexer means responsive to the output of said coincidence detecting means for establishing said data transmission path between said two microprocessor means.

5. An apparatus for controlling an electronic controlled cooking apparatus, comprising:

energy generating means for generating energy for cooking a material being cooked, entry means for providing data concerning cooking conditions being applied to said material being cooked, storage means for storing data concerning a fixed cooking condition corresponding to a specified one of the pieces of said cooking condition data being provided by said entry means, data display means comprising a plurality of display digit positions for displaying at least said cooking accordance with the data entered into and transmitted from said one microprocessor means.

6. A control apparatus in accordance with claim 1 or claim 5, which further comprises:

temperature measuring means for measuring a temperature of said material being cooked, said temperature measuring means being coupled to one of said one microprocessor means and said other microprocessor means, and said other microprocessor means is responsive to the temperature data obtained from said temperature measuring means for controlling said energy generating means.

7. An apparatus for controlling an electronic controlled cooking apparatus, comrprising:

energy generating means for generating energy for cooking a material being cooked, entry means for providing data concerning cooking conditions being applied to said material being cooked, storage means for storing data concerning a fixed cooking condition corresponding to a specified one of the pieces of said cooking condition data being provided by said entry means, data display means for displaying at least said cooking condition data entered by said entry means, control means responsive to at least one of said cooking condition data entered by said entry means and said fixed cooking condition data obtained from said storage means for controlling said energy generating means, said control means comprising at least two microprocessor means, at least one of said microprocessor means being adapted to detect said cooking condition data entered by said entry means, at least one other of said microprocessor means being responsive to the data received from said one microprocessor means to control said energy generating means and to control said data display means to display the data received from said one microprocessor means, each of said at least two microprocessor means further comprising means for providing cyclically a separate individual synchronizing signal, coincidence detecting means for detecting coincidence of said synchronizing signals of said at least two microprocessor means, multiplexer means responsive to the output of said coincidence detecting means for establishing a data transmission path between said at least two microprocessor means, said one microprocessor means further providing another synchronizing signal, different from said first named synchronizing signal, to said entry means and said multiplexer means, and wherein said multiplexer means is interposed between said entry means and said one microprocessor means and is responsive to said another synchronizing signal to establish a data transmission path from said entry means to said one microprocessor means.

8. A control apparatus in accordance with claim 7, wherein said entry means comprises a keyboard having keys, a key matrix including a plurality of column lines and a plurality of row lines, said keys of said keyboard being disposed at the respective intersections between said column lines and said row lines, and encoder means responsive to the signals from said respective row lines of said key matrix for generating binary codes corresponding to the operated keys.

9. A control apparatus in accordance with claim 8, wherein said one microprocessor means transfers the binary codes corresponding to said keys at a plurality of timings respectively associated with said column lines in transmission of keyboard data to said one microprocessor means.

10. An apparatus for controlling an electronic controlled cooking apparatus, comprising:

energy generating means for generating energy for cooking a material being cooked, entry means for providing data concerning cooking conditions being applied to said material being cooked, storage means for storing data concerning a fixed cooking condition corresponding to a specified one of the pieces of said cooking condition data being provided by said entry means, data display means for displaying at least said cooking condition data entered by said entry means, control means responsive to at least one of said cooking condition data entered by said entry means and said fixed cooking condition data obtained from said storage means for controlling said energy generating means, said control means comprising at least two microprocessor means, at least one of said at least two microprocessor means being adapted to detect said cooking condition data entered by said entry means, at least the other of said at least two microprocessor means being responsive to the data received from said one microprocessor means to control said energy generating means and to control said data display means to display the data received from said one microprocessor means, said other microprocessor means further comprising means for generating a plurality of synchronizing signals each having a corresponding different timing, demand signal providing means for selectively providing at least a predetermined one of said plurality of synchronizing signals to said one microprocessor means, synchronizing signal supplying means for supplying to said one microprocessor means at least one of said synchronizing signals which is not selected by said demand signal providing means among said synchronizing signals from said other microprocessor means, and wherein said one microprocessor means is responsive to said demand signal and said synchronizing signals to transfer said data to said other microprocessor means.

11. A control apparatus in accordance with claim 10, wherein the trailing edge of at least one of said synchronizing signals selected by said demand signal supplying means among said plurality of synchronizing signals obtained from said other microprocessor means is timed to overlap the occurrence of the succeeding synchronizing signal, and said one microprocessor means is adapted to detect the logic state of said succeeding condition data entered by said entry means, and control means responsive to at least one of said cooking condition data entered by said entry means and said fixed cooking condition data obtained from said storage means for controlling said energy generating means, said control means comprising at least two independently operable microprocessor means which cooperate with each other, data transmission means for providing a data transmission path between said two microprocessor means, at least one of said at least two microprocessor means being adapted to detect said cooking condition data entered by said entry means, at least the other of said at least two microprocessor means being responsive to the data received from said one microprocessor means to control said energy generating means and one of said two microprocessor means also for controlling said data display means to display the data received by said one microprocessor means, said other microprocessor means further comprising means for generating a plurality of digit selecting signals for designating said display digit positions to said data display means, said data transmission means further comprising demand signal providing means for selectively providing at least a predetermined one of said digit selecting signals to said one microprocessor means, and said one microprocessor means comprises means responsive to said demand signal to directly transfer data to said other microprocessor means to be received thereby for controlling said heating energy generating means in synchronizing signal at the timing of the trailing edge of said demand signal for determining whether said data is to be transferred.

12. A control apparatus as in either of claims 10 or 11, wherein:

said data display means comprises a plurality of display digit positions, said other microprocessor means is adapted to provide digit selecting signals for designating said display digit positions to said display means, and wherein said digit selecting signals are used as said synchronizing signals.

13. An apparatus for controlling an electronic controlled cooking apparatus, comprising:

energy generating means for generating energy for cooking a material being cooked, entry means for providing data concerning cooking conditions being applied to said material being cooked, storage means for storing data concerning a fixed cooking condition corresponding to a specified one of the pieces of said cooking condition data being provided by said entry means, data display means for displaying at least said cooking condition data entered by said entry means, and control means responsive to at least one of said cooking condition data entered by said entry means and said fixed cooking condition data obtained from said storage means for controlling said energy generating means, said control means comprising at least two microprocessor means, at least one of said at least two microprocessor means being adapted to detect said cooking condition data entered by said entry means, at least the other of said at least two microprocessor means being responsive to the data received from said one microprocessor means to control said energy generating means and to control said data display means to display the data received from said one microprocessor means, said other microprocessor means further comprising means for generating a synchronizing signal, demand signal providing means for providing a demand signal to said one microprocessor means based on said synchronizing signal, said one microprocessor means comprising means responsive to said demand signal to transfer data to said other microprocessor means, said entry means further comprising a keyboard having keys, a key matrix including a plurality of column lines and a plurality of row lines, said keys of said keyboard being disposed at the respective intersections between said column lines and said row lines, and encoder means responsive to the signals from said row lines of said key matrix for generating binary codes corresponding to the operated keys, and said one microprocessor means comprises means for providing a plurality of column identifying signals for identifying in succession said plurality of column lines in said key matrix.

14. A control apparatus in accordance with claim 13, wherein said one microprocessor means receives the binary codes corresponding to said keys at a plurality of timings respectively associated with said column lines in transmission of keyboard data to said one microprocessor means.

15. A control apparatus in accordance with claim 14, wherein said one microprocessor means transfers said binary codes to said other microprocessor means responsive to said demand signals for reading said data by said other microprocessor means.

16. A control apparatus in accordance with any one of claims 13, 14, or 15, wherein said data display means comprises a plurality of display digit positions, said other microprocessor means is adapted to provide digit selecting signals for designating said display digit positions to said data display means, at least one of said digit selecting signals being used as said synchronizing signal.

17. An apparatus for controlling an electronic controlled cooking apparatus, comprising:

energy generating means for generating energy for cooking a material being cooked, entry means for providing data concerning cooking conditions being applied to said material being cooked, storage means for storing data concerning a fixed cooking condition corresponding to a specified one of the pieces of said cooking condition data being provided by said entry means, data display means for displaying at least said cooking condition data entered by said entry means, control means responsive to at least one of said cooking condition data entered by said entry means and said fixed cooking condition data obtained from said storage means for controlling said energy generating means, said control means comprising at least two microprocessor means, at least one of said microprocessor means being adapted to detect said cooking condition data entered by said entry means, at least one other of said microprocessor means being responsive to the data received from said one microprocessor means to control said energy generating means and to control said data display means to display the data received from said one microprocessor means, each of said at least two microprocessor means further comprising means for providing cyclically a separate individual synchronizing signal, coincidence detecting means for detecting coincidence of said synchronizing signals of said at least two microprocessor means, multiplexer means responsive to the output of said coincidence detecting means for establishing a data transmission path between said at least two microprocessor means, and wherein said multiplexer means is also interposed between said storage means and said one microprocessor means, pg,94 said one microprocessor means is adapted to provide another synchronizing signal which is different from said synchronizing signals to said storage means and said multiplexer means, and said multiplexer means is responsive to said another synchronizing signal to establish a data transmission path between said storage means and said one microprocessor means.

18. A control apparatus in accordance with claim 17, wherein said multiplexer means is further interposed between said entry means and said one microprocessor means, said one microprocessor means is adapted to provide a further synchronizing signal, different from said synchronizing signals and said another synchronizing signal, to said entry means and said multiplexer means, and said multiplexer means is responsive to said further synchronizing signal to establish a data transmission path from said entry means to said one microprocessor means.

* * * * *

UNITED STATES PATENT AND TRADEMARK OFFICE

CERTIFICATE OF CORRECTION

PATENT NO. : 4,356,370

DATED : October 26, 1982

INVENTOR(S) : Atsushi Horinouchi

It is certified that error appears in the above-identified patent and that said Letters Patent are hereby corrected as shown below:

Claim 5 should read as follows:

5. An apparatus for controlling an electronic controlled cooking apparatus, comprising:

energy generating means for generating energy for cooking a material being cooked, entry means for providing data concerning cooking conditions being applied to said material being cooked, storage means for storing data concerning a fixed cooking condition corresponding to a specified one of the pieces of said cooking condition data being provided by said entry means, data display means comprising a plurality of display digit positions for displaying at least said cooking condition data entered by said entry means, and control means responsive to at least one of said cooking condition data entered by said entry means and said fixed cooking condition data obtained from said storage means for controlling said energy generating means, said control means comprising at least two independently operable microprocessor means which cooperate with each other, data transmission means for providing a data transmission path between said two microprocessor means, at least one of said at least two microprocessor means being adapted to detect said cooking condition data entered by said entry means, at least the other of said at least two microprocessor means being responsive to the data received from said one microprocessor means to control said energy generating means and one of said two microprocessor means also for controlling said data display means to It is certified that error appears in the above-identified patent and that said Letters Patent are hereby corrected as shown below:

display the data received by said one microprocessor means, said other microprocessor means further comprising means for generating a plurality of digit selecting signals for designating said display digit positions to said data display means, said data transmission means further comprising demand signal providing means for selectively providing at least a predetermined one of said digit selecting signals to said one microprocessor means, and said one microprocessor means comprises means responsive to said demand signal to directly transfer data to said other microprocessor means to be received thereby for controlling said heating energy generating means in accordance with the data entered into and transmitted from said one microprocessor means.

In claim 17, line 46, delete "pg,94".

Claim 11 should read as follows:

UNITED STATES PATENT AND TRADEMARK OFFICE

CERTIFICATE OF CORRECTION

PATENT NO. : 4,356,370

DATED : October 26, 1982

INVENTOR(S) : Atsushi Horinouchi

It is certified that error appears in the above-identified patent and that said Letters Patent is hereby corrected as shown below:

-- 11. A control apparatus in accordance with claim 10 wherein the trailing edge of at least one of said synchronizing signals selected by said demand signal supplying means among said plurality of synchronizing signals obtained from said other microprocessor means is timed to overlap the occurrence of the succeeding synchronizing signal, and said one microprocessor means is adapted to detect the logic state of said succeeding synchronizing signal at the timing of the trailing edge of said demand signal for determining whether said data is to be transferred. --.

Signed and Sealed this

Fifth Day of June 1984

[SEAL]

Attest:

GERALD J. MOSSINGHOFF

Attesting Officer

Commissioner of Patents and Trademarks